US009327934B2

(12) United States Patent
Nomura et al.

(10) Patent No.: US 9,327,934 B2
(45) Date of Patent: May 3, 2016

(54) SHEET STACKING APPARATUS AND SHEET STACKING METHOD

(71) Applicant: KABUSHIKI KAISHA ISOWA, Nagoya-shi, Aichi (JP)

(72) Inventors: Takayuki Nomura, Komaki (JP); Yusuke Tozuka, Nagoya (JP)

(73) Assignee: KABUSHIKI KAISHA ISOWA, Nagoya-Shi (JP)

( * ) Notice: Subject to any disclaimer, the term of this patent is extended or adjusted under 35 U.S.C. 154(b) by 0 days.

(21) Appl. No.: 14/738,196

(22) Filed: Jun. 12, 2015

(65) Prior Publication Data

US 2015/0368064 A1 Dec. 24, 2015

(30) Foreign Application Priority Data

Jun. 20, 2014 (JP) ..... 2014-127737

(51) Int. Cl.

*B65H 31/20* (2006.01)
*B65H 31/36* (2006.01)
*B65H 43/00* (2006.01)
(Continued)

(52) U.S. Cl.

CPC ..... *B65H 31/36* (2013.01); *B65H 7/02* (2013.01); *B65H 7/20* (2013.01); *B65H 9/06* (2013.01); *B65H 9/103* (2013.01); *B65H 31/08* (2013.01); *B65H 31/20* (2013.01); *B65H 31/26* (2013.01); *B65H 43/00* (2013.01); *B65H 2405/1134* (2013.01); *B65H 2511/11* (2013.01)

(58) Field of Classification Search

CPC ..... B65H 9/004; B65H 9/006; B65H 9/008; B65H 9/06; B65H 9/10; B65H 9/103; B65H 9/106; B65H 29/12; B65H 29/125; B65H 29/14; B65H 29/16; B65H 29/18; B65H 29/20; B65H 29/22; B65H 31/02; B65H 31/04; B65H 31/08; B65H 31/10; B65H 31/20; B65H 31/26; B65H 31/34; B65H 31/36; B65H 43/00; B65H 2405/113; B65H 2405/1134; B65H 2511/11

USPC ..... 271/221, 224

See application file for complete search history.

(56) References Cited

U.S. PATENT DOCUMENTS 6,073,925 A * 6/2000 Sato ..... B65H 7/02 271/171
6,102,385 A * 8/2000 Wakamatsu ..... B65H 31/34 270/58.07

(Continued)

FOREIGN PATENT DOCUMENTS

JP 5284727 B2 6/2013

*Primary Examiner* — Prasad Gokhale
(74) *Attorney, Agent, or Firm* — Brinks Gilson & Lione

(57) ABSTRACT

Disclosed is a sheet stacking apparatus which includes: a leading-edge regulating member configured to be positionally adjustable depending on a length of a plurality of corrugated paperboard sheets; a sheet stopper installed in the leading-edge regulating member in such a manner as to be movable with respect to a contact surface of the leading-edge regulating member reciprocatingly between a first position and a second position, and contactable with a leading edge of the corrugated paperboard sheet to be stacked in the hopper section; a detection section disposed upstream of the hopper section, and configured to detect a passing of each of the corrugated paperboard sheets; and a synchronization control device configured to reciprocatingly move the sheet stopper according to a detection signal, in such a manner as to allow the leading edge of the corrugated paperboard sheet to come into contact with the sheet stopper.

12 Claims, 12 Drawing Sheets

(51) Int. Cl.

| | |
|---|---|
| ***B65H 31/26*** | (2006.01) |
| ***B65H 7/20*** | (2006.01) |
| ***B65H 7/02*** | (2006.01) |
| ***B65H 9/06*** | (2006.01) |
| ***B65H 9/10*** | (2006.01) |
| ***B65H 31/08*** | (2006.01) |

(56) References Cited

U.S. PATENT DOCUMENTS 6,354,588 B1 * 3/2002 Kuwahara ..... B65H 31/02 271/224
6,494,450 B2 * 12/2002 Tsurumaki ..... B65H 31/02 271/220
7,464,930 B2 * 12/2008 Masuda ..... B65H 31/20 271/223
8,033,543 B2 * 10/2011 Hayashi ..... B65H 31/34 271/213
2001/0010193 A1 * 8/2001 Tsurumaki ..... B65H 31/02 101/232
2011/0268551 A1 * 11/2011 Kokubo ..... B65H 31/20 414/796
2012/0027554 A1 * 2/2012 Lee ..... B65H 31/36 414/788.9

* cited by examiner

X
PL1
2R
R
DX3
0
T
TL10
TL11-1
TL12-1
(TLA1-1)
TL13
TL14
TL15
TL20
(TL16)

V
VFS
VFL
SPL
SPL-1
0
T
TL10
TL11-1
TL12-1
(TLA1-1)
TL13
TL14
TL15
TL20
(TL16)

SHEET STACKING APPARATUS AND SHEET STACKING METHOD

RELATED APPLICATIONS

This application claims priority under 35 U.S.C. §119 to Japanese Patent Application No. 2014-127737 filed on Jun. 20, 2014, the entire content of which is hereby incorporated by reference.

BACKGROUND OF THE INVENTION

1. Field of the Invention

The present invention relates to a sheet stacking apparatus and a sheet stacking method which are applicable to a corrugated paperboard box making machine.

2. Description of the Related Art

Heretofore, various proposals have been made regarding a sheet stacking apparatus equipped with a leading-edge regulating member. For example, a hopper apparatus described in the following Patent Document 1 comprises a front contact plate contactable with a flattened corrugated paperboard box conveyed and stacked (transferred) therein. The front contact plate is primarily comprised of a support plate, a plate spring and a protective plate. The plate spring and the protective plate are suspended with play, with respect to an obverse surface of the support plate. A closed or open cell sponge rubber is interposed between the support plate and the plate spring. The plate spring is made of a metal, and configured to have a spring constant equal to that of the sponge rubber, in regard to collision with the flattened corrugated paperboard box. The protective plate is made of a hard resin, such as hard urethane rubber.

In the hopper apparatus described in the Patent Document 1, when a plurality of flattened corrugated paperboard boxes sequentially collide with the front contact plate from an obverse side of the front contact plate, a cyclic load is applied to the plate spring and the protective plate for a long time period. In regard to the cyclic load, the plate spring itself has elasticity, and the sponge rubber is interposed between the support plate and the plate spring. Thus, the front contact plate described in the Patent Document 1 has a significant effect of absorbing an impact force from the flattened corrugated paperboard box.

CITATION LIST

Patent Document

Patent Document 1: JP 5284727B

SUMMARY OF THE INVENTION

Technical Problem

The front contact plate described in the Patent Document 1 has the significant impact force absorbing effect, as mentioned above. This is effective at suppressing the occurrence of a situation where a leading edge portion of the flattened corrugated paperboard box is damaged due to the collision. However, since each of the protective plate, the plate spring and the sponge rubber receives an impact force from the flattened corrugated paperboard box, degradation in property, such as low frictional property or elasticity, inevitably occurs during the course of its usage. Moreover, along with an increase in transfer speed of the flattened corrugated paperboard box, the degradation appears at an earlier stage. Thus, it is likely that the desired impact force absorbing effect cannot be maintained unless maintenance/inspection work for the front contact plate is frequently performed.

In view of the above circumstances, it is therefore an object of the present invention to provide a sheet stacking apparatus and a sheet stacking method which are capable of reducing burden of maintenance/inspection work and replacement work, and suppressing damage to a corrugated paperboard sheet.

Solution to Technical Problem

According to a first aspect of the present invention, there is provided a sheet stacking apparatus which comprises: a hopper section configured to allow a plurality of folded and glued corrugated paperboard sheets to be stacked therein from a sheet transfer section in a transfer direction and stacked therein; a leading-edge regulating member configured to be positionally adjustable depending on a length of the corrugated paperboard sheets in the transfer direction so as to delimit a downstream-side position of a stacking space of the hopper section in the transfer direction, wherein the leading-edge regulating member has a contact surface contactable with respective leading edges of the stacked corrugated paperboard sheets; a sheet stopper installed in the leading-edge regulating member in such a manner as to be movable in the transfer direction with respect to the contact surface of the leading-edge regulating member reciprocatingly between a first position and a second position set downstream of the first position, and contactable with the leading edge of the corrugated paperboard sheet to be stacked in the hopper section; a detection section disposed upstream of the hopper section in the transfer direction, and configured to detect a passing of each of the corrugated paperboard sheets; and a synchronization control device configured to reciprocatingly move the sheet stopper according to a detection signal from the detection section, in such a manner as to allow the leading edge of the corrugated paperboard sheet to come into contact with the sheet stopper being moved from the first position toward the second position.

In the sheet stacking apparatus of the present invention, the synchronization control device reciprocatingly moves the sheet stopper according to a detection signal from the detection section, in such a manner as to allow the leading edge of the corrugated paperboard sheet to come into contact with the sheet stopper being moved from the first position toward the second position. Therefore, the leading edge of the corrugated paperboard sheet comes into contact with the sheet stopper being moved from the first position toward the second position in the same direction as the transfer direction, and, as a result of this contact, a speed of the corrugated paperboard sheet is gradually reduced until the corrugated paperboard sheet reaches a static or stopped state. A contact force at a time when the leading edge of the corrugated paperboard sheet initially comes into contact with the sheet stopper, and a contact force during a subsequent time period in which the contact is maintained, are determined depending on a relative speed between the corrugated paperboard sheet and the sheet stopper, so that the contact force becomes reduced as compared to the conventional apparatus in which the leading edge of the corrugated paperboard sheet collides with the front contact plate in a static state. The reduction in contact force makes it possible to suppress damage to the corrugated paperboard sheet. In addition, the reduction in contact force acting on the sheet stopper makes it possible to suppress degradation of a contact surface of the sheet stopper, even in long-term usage, thereby reducing burden of maintenance/inspection work and replacement work. The synchronization control device reciprocatingly moves the sheet stopper according to the detection signal from the detection section. Therefore, the reciprocating motion of the sheet stopper can be accurately synchronized with sequential transfer of the corrugated paperboard sheets by the sheet transfer section, without being influenced by a conveyance delay occurring in the course of conveying the corrugated paperboard sheet to the sheet transfer section.

In the sheet stacking apparatus of the present invention, as long as the sheet stopper is configured to be reciprocatingly movable between the first position and the second position, it may be configured to perform a linear reciprocating motion or may be configured to perform a rotational or swinging reciprocating motion. Further, as long as the sheet stopper is configured to be reciprocatingly movable with respect to the contact surface of the leading-edge regulating member, the first position is not limited to a position offset upstream of the contact surface of the leading-edge regulating member in the transfer direction, but may be set to a position flush with the contact surface of the leading-edge regulating member.

In the sheet stacking apparatus of the present invention, as long as the synchronization control device is configured to synchronize the reciprocating motion of the sheet stopper with sequential transfer of the corrugated paperboard sheets by the sheet transfer section, it may be configured to synchronize one cycle of the reciprocating motion with transfer of a respective one of the corrugated paperboard sheets by the sheet transfer section, or may be configured to synchronize plural cycles of the reciprocating motion with transfer of a respective one of the corrugated paperboard sheets by the sheet transfer section.

In the sheet stacking apparatus of the present invention, as long as the leading edge of the corrugated paperboard sheet can come into contact with the sheet stopper when the sheet stopper is being moved from the first position toward the second position, the synchronization control device may be configured to control the reciprocating motion in such a manner as to allow a movement speed of the sheet stopper to always become equal to or less than a transfer speed of the corrugated paperboard sheets, or may be configured to control the reciprocating motion in such a manner as to allow the movement speed of the sheet stopper to temporarily exceed the transfer speed of the corrugated paperboard sheets.

Preferably, in the sheet stacking apparatus of the present invention, the synchronization control device comprises: a drive motor; a transmission mechanism for transmitting a driving force of the drive motor to the sheet stopper; and a drive control section for controlling driving of the drive motor according to the detection signal from the detection section.

In the sheet stacking apparatus having this feature, the transmission mechanism transmits a driving force of the drive motor to the sheet stopper. Further, the drive control section controls driving of the drive motor according to the detection signal from the detection section. Therefore, even in a situation where the sheet length or the transfer speed of the corrugated paperboard sheets is changed in accordance with order change, the drive control section can control a driving start timing, a driving speed or the like of the drive motor in such a manner as to synchronize the reciprocating motion of the sheet stopper with sequential transfer of the corrugated paperboard sheets by the sheet transfer section.

In this sheet stacking apparatus, in the case where the drive motor is rotationally driven, the transmission mechanism may be configured to transmit a rotational motion of the drive motor directly to the sheet stopper, or may be configured to convert the rotational motion of the drive motor to a different type of motion, such as a linear motion, and then transmit the converted motion to the sheet stopper. On the other hand, in the case where the drive motor is a linear motor, the transmission mechanism may be configured to transmit a linear motion of a mover of the drive motor directly to the sheet stopper.

In this sheet stacking apparatus, as long as the drive control section operates to controllably synthesizes the reciprocating motion of the sheet stopper with sequential transfer of the corrugated paperboard sheets by the sheet transfer section, it may be configured control the driving of the drive motor, based on at least one control parameter selected, for example, from the group consisting of driving speed, activation and deactivation, driving amount and driving direction of the drive motor.

Preferably, in the above sheet stacking apparatus, the drive control section is operable to control the driving of the drive motor according to the detection signal from the detection section, in such a manner as to allow the leading edge of the corrugated paperboard sheet to come into contact with the sheet stopper when a movement speed of the sheet stopper being moved from the first position toward the second position reaches a given maximum movement speed, or when the movement speed is being reduced from the given maximum movement speed.

In the sheet stacking apparatus having this feature, the drive control section controls the driving of the drive motor according to the detection signal from the detection section, in such a manner as to allow the leading edge of the corrugated paperboard sheet to come into contact with the sheet stopper when a movement speed of the sheet stopper being moved from the first position toward the second position reaches a given maximum movement speed, or when the movement speed is being reduced from the given maximum movement speed. Therefore, it becomes possible to reliably reduce the speed of the corrugated paperboard sheet while keeping a contact force acting on the corrugated paperboard sheet at a sufficiently small value, thereby further suppressing damage to the corrugated paperboard sheet.

In this sheet stacking apparatus, the given maximum movement speed may be greater than the transfer speed of the corrugated paperboard sheets, or may be less than the transfer speed of the corrugated paperboard sheets.

Preferably, in the above sheet stacking apparatus, the drive control section is operable to control the driving speed of the drive motor, in such a manner as to move the sheet stopper from the first position toward the second position at a speed equal to or less than the transfer speed of the corrugated paperboard sheets.

In the sheet stacking apparatus having this feature, the drive control section controls the driving speed of the drive motor, in such a manner as to move the sheet stopper from the first position toward the second position at a speed equal to or less than the transfer speed of the corrugated paperboard sheets. Therefore, it becomes possible to allow the leading edge of the corrugated paperboard sheet to reliably come into contact with the sheet stopper, while keeping the driving speed of the drive motor at a relatively low speed.

In this sheet stacking apparatus, when the sheet stopper is being moved from the second position to the first position, the movement speed of the sheet stopper may temporarily exceed the transfer speed of the corrugated paperboard sheets, or may be always equal to or less than the transfer speed of the corrugated paperboard sheets.

Preferably, in the above sheet stacking apparatus, the transmission mechanism comprises a conversion mechanism for converting a rotational motion of a rotor configured to be driven by the drive motor, to a linear reciprocating motion of the sheet stopper, wherein the conversion mechanism is installed in the leading-edge regulating member.

In the sheet stacking apparatus having this feature, the conversion mechanism is installed in the leading-edge regulating member to convert a rotational motion of a rotor configured to be driven by the drive motor, to a linear reciprocating motion of the sheet stopper, Therefore, the sheet stopper is moved such that the contact surface thereof performs a reciprocating motion without deviating from the transfer direction, so that it becomes possible to keep a contact posture of the leading edge of the corrugated paperboard sheet with respect to the sheet stopper approximately constant, thereby causing the leading edge of the corrugated paperboard sheet to reliably come into contact with the sheet stopper.

In this sheet stacking apparatus, various configurations are conceivable as the conversion mechanism. For example, as the conversion mechanism, it is possible to use a combination of a crankshaft and a connecting rod, a combination of a cam and a contact, a combination of a rack and a pinion, or the like. For the reciprocating motion of the sheet stopper, the drive motor may be configured to be rotated in one direction, or may be configured to be rotated in both forward and reverse directions, depending on the configuration of the conversion mechanism.

Preferably, in the above sheet stacking apparatus, the drive control section is operable to control the driving of the drive motor according to the detection signal from the detection section, in such a manner as to allow the sheet stopper to perform one cycle of the reciprocating motion, every time the sheet transfer section conveys and stacks one of the corrugated paperboard sheets into the hopper section.

In the sheet stacking apparatus having this feature, the drive control section controls the driving of the drive motor according to the detection signal from the detection section, in such a manner as to allow the sheet stopper to perform one cycle of the reciprocating motion, every time the sheet transfer section conveys and stacks one of the corrugated paperboard sheets into the hopper section. Therefore, it becomes possible to accurately synchronize the reciprocating motion of the sheet stopper with sequential transfer of the corrugated paperboard sheets by the sheet transfer section, while keeping the driving speed of the drive motor at a relatively low speed. In addition, as compared to a configuration in which the sheet stopper performs plural cycles of the reciprocating motion within a transfer period for a respective one of the corrugated paperboard sheets, the contact force acting between the leading edge of the corrugated paperboard sheet and the sheet stopper can be reduced, because it is not necessary to rapidly reduce the speed of the sheet stopper.

In this sheet stacking apparatus, a period during which the sheet transfer section conveys and stacks one of the corrugated paperboard sheets into the hopper section is equivalent to a period during which the corrugated paperboard sheet is conveyed by a distance corresponding to an interval between respective leading edges of two of the corrugated paperboard sheets being successively conveyed and stacked. Generally, it is equivalent to a period during which a printing cylinder, called "plate cylinder", of a printing device equipped in a corrugated paperboard box making machine, is rotated 360 degrees. The sheet transfer section conveys and stacks one of the corrugated paperboard sheets into the hopper section, every the transfer period.

Preferably, in the above sheet stacking apparatus, the leading-edge regulating member comprises a plurality of support portions arranged at given intervals in a width direction of the corrugated paperboard sheets being conveyed and stacked, and a frame to which the plurality of support portions are fixed, and the sheet stopper is provided in a plural number, wherein: the plurality of sheet stoppers are supported, respectively, by the plurality of support portions; the drive motor is fixed to the frame; and the transmission mechanism is configured to transmit the driving force of the drive motor to each of the plurality of sheet stoppers.

In sheet stacking apparatus having this feature, the transmission mechanism transmits the driving force of the drive motor fixed to the frame to each of the plurality of sheet stoppers. Therefore, it becomes possible to accurately synthesize respective reciprocating motions of the plurality of sheet stoppers with sequential transfer of the corrugated paperboard sheets by the sheet transfer sections.

Preferably, in the above sheet stacking apparatus, the drive control section is operable to sequentially execute: a first operation of starting the driving of the drive motor according to the detection signal from the detection section, in such a manner as to allow the sheet stopper to start the movement from the first position toward the second position; a second operation of controlling the driving of the drive motor in such a manner as to increase a movement speed of the sheet stopper being moved from the first position toward the second position to reach a given maximum movement speed; and a third operation of controlling the driving of the drive motor in such a manner as to reduce the movement speed of the sheet stopper from the given maximum movement speed to thereby allow the sheet stopper to reach the second position, wherein a time period from the start of the driving of the drive motor in the first operation through until the movement speed of the sheet stopper reaches the given maximum movement speed in the second operation is shorter than a time period from a time when the movement speed of the sheet stopper reaches the given maximum movement speed in the second operation through until the sheet stopper reaches the second position.

In the sheet stacking apparatus, a time period from the start of the driving of the drive motor in the first operation through until the movement speed of the sheet stopper reaches the given maximum movement speed in the second operation is shorter than a time period from a time when the movement speed of the sheet stopper reaches the given maximum movement speed in the second operation through until the sheet stopper reaches the second position. Therefore, it becomes possible to rapidly increase the movement speed of the sheet stopper to the given maximum movement speed, and possibly extend a time period from a time when the leading edge of the corrugated paperboard sheet comes into contact with the sheet stopper through until the corrugated paperboard sheet reaches a static state, thereby further suppressing damage to the corrugated paperboard sheet.

Preferably, in the above sheet stacking apparatus, the drive control section is operable to sequentially execute: a first operation of starting the driving of the drive motor according to the detection signal from the detection section, in such a manner as to allow the sheet stopper to start the movement from the first position toward the second position; a second operation of controlling the driving of the drive motor in such a manner as to increase a movement speed of the sheet stopper being moved from the first position toward the second position to reach a given maximum movement speed; a third operation of controlling the driving of the drive motor in such a manner as to reduce the movement speed of the sheet stopper from the given maximum movement speed to thereby allow the sheet stopper to reach the second position; a fourth operation of controlling the driving of the drive motor in such a manner as to allow the sheet stopper to start a movement from the second position toward the first position; and a fifth operation of stopping the driving of the drive motor when the sheet stopper reaches the first position, and maintaining a stopped state of the drive motor until the detection signal is subsequently newly generated.

In the sheet stacking apparatus having the above feature, the drive control section sequentially executes: a first operation of starting the driving of the drive motor according to the detection signal from the detection section, in such a manner as to allow the sheet stopper to start the movement from the first position toward the second position; a second operation of controlling the driving of the drive motor in such a manner as to increase a movement speed of the sheet stopper reaches a given maximum movement speed; a third operation of controlling the driving of the drive motor in such a manner as to reduce the movement speed of the sheet stopper from the given maximum movement speed to thereby allow the sheet stopper to reach the second position; a fourth operation of controlling the driving of the drive motor in such a manner as to allow the sheet stopper to start a movement from the second position toward the first position; and a fifth operation of stopping the driving of the drive motor when the sheet stopper reaches the first position, and maintaining a stopped state of the drive motor until the detection signal is subsequently newly generated. Therefore, the drive control section can repeat a series of operations consisting of the first to second operations to accurately synthesize the reciprocating motion of the sheet stopper with sequential transfer of the corrugated paperboard sheets by the sheet transfer sections.

Preferably, in the above sheet stacking apparatus, the drive control section is operable to calculate a time period from a time when the detection section generates the detection signal through until the driving of the drive motor is started in the first operation, based on a transfer speed of the corrugated paperboard sheets, and a distance between an installation position of the detection section and a predetermined position where the leading edge of the corrugated paperboard sheet comes into contact with the sheet stopper, in the transfer direction.

In the sheet stacking apparatus having the above feature, the drive control section operates to calculate a time period from a time when the detection section generates the detection signal through until the driving of the drive motor is started in the first operation, based on a transfer speed of the corrugated paperboard sheets, and a distance between an installation position of the detection section and a predetermined position where the leading edge of the corrugated paperboard sheet comes into contact with the sheet stopper, in the transfer direction. Therefore, even in a situation where the sheet length or the transfer speed of the corrugated paperboard sheets is changed in accordance with order change, the reciprocating motion of the sheet stopper can be further accurately synchronized with sequential transfer of the corrugated paperboard sheets by the sheet transfer section.

In this sheet stacking apparatus, the predetermined position where the leading edge of the corrugated paperboard sheet comes into contact with the sheet stopper may be a position of the sheet stopper at a time when the movement speed of the sheet stopper reaches the given maximum movement speed, or may be a position of the sheet stopper at a time when the movement speed of the sheet stopper is reduced from the given maximum movement speed for a given time.

According to a second aspect of the present invention, there is provided a sheet stacking method for a sheet stacking apparatus, wherein the sheet stacking apparatus comprises: a hopper section configured to allow a plurality of folded and glued corrugated paperboard sheets to be thereinto from a sheet transfer section in a transfer direction; and a leading-edge regulating member configured to be positionally adjustable depending on a length of the corrugated paperboard sheets in the transfer direction so as to delimit a downstream-side position of a stacking space of the hopper section in the transfer direction, wherein the leading-edge regulating member has a contact surface contactable with leading edges of the corrugated paperboard sheets. The sheet stacking method comprises: a first movement step of, in one transfer period during which one of the corrugated paperboard sheets is stacked in the hopper section by the sheet transfer section, moving a sheet stopper reciprocatingly movable in the transfer direction with respect to the contact surface of the leading-edge regulating member, from a first position toward a second position set downstream of the first position; a second movement step of, in the same transfer period as that during which the first movement step is executed, moving the sheet stopper from the second position to the first position; a detection step of detecting a passing of each of the corrugated paperboard sheets at a position upstream of the hopper section in the transfer direction; a synchronization step of executing the first movement step according to the detection of the passing of each of the corrugated paperboard sheets, in such a manner as to allow the leading edge of the corrugated paperboard sheet to come into contact with the sheet stopper being moved in the first movement step; and a stacking step of stacking in the hopper section the corrugated paperboard sheets stopped by coming into contact with the sheet stopper.

In the sheet stacking method of the present invention, the first movement step is executed to, in the one transfer period, move the sheet stopper from the first position toward the second position. The second movement step is executed to move the sheet stopper from the second position to the first position, in the same transfer period as that during which the first movement step is executed. The synchronization step is executed to cause the first movement step to be executed according to the detection of the passing of each of the corrugated paperboard sheets, in such a manner as to allow the leading edge of the corrugated paperboard sheet to come into contact with the sheet stopper being moved in the first movement step. Therefore, the leading edge of the corrugated paperboard sheet comes into contact with the sheet stopper being moved from the first position toward the second position in the same direction as the transfer direction, and, as a result of this contact, a speed of the corrugated paperboard sheet is gradually reduced until the corrugated paperboard sheet reaches a static or stopped state. A contact force at a time when the leading edge of the corrugated paperboard sheet initially comes into contact with the sheet stopper, and a contact force during a subsequent time period in which the contact is maintained, are determined depending on a relative speed between the corrugated paperboard sheet and the sheet stopper, so that the contact force becomes reduced as compared to the conventional apparatus in which the leading edge of the corrugated paperboard sheet collides with the front contact plate in a static state. The reduction in contact force makes it possible to suppress damage to the corrugated paperboard sheet. In addition, the reduction in contact force acting on the sheet stopper makes it possible to suppress degradation of a contact surface of the sheet stopper, even in long-term usage, thereby reducing burden of maintenance/inspection work and replacement work. The synchronization step is executed to cause the first movement step to be executed according to the detection signal from the detection section. Therefore, the reciprocating motion of the sheet stopper can be accurately synchronized with sequential transfer of the corrugated paperboard sheets by the sheet transfer section, without being influenced by a conveyance delay occurring in the course of conveying the corrugated paperboard sheet to the sheet transfer section.

DETAILED DESCRIPTION OF THE PREFERRED EMBODIMENTS

With reference to accompanying drawings, a corrugated paperboard box making machine for processing such as printing, slotting and punching to a corrugated paperboard sheet will now be described, wherein a sheet stacking apparatus according to one embodiment of the present invention is applied thereto. In the following description, an up-down direction, a right-left direction and a front-rear direction are defined according to respective directions indicated by the arrowed lines in the figures.

<<Corrugated Paperboard Box Making Machine>>

Figure 1:
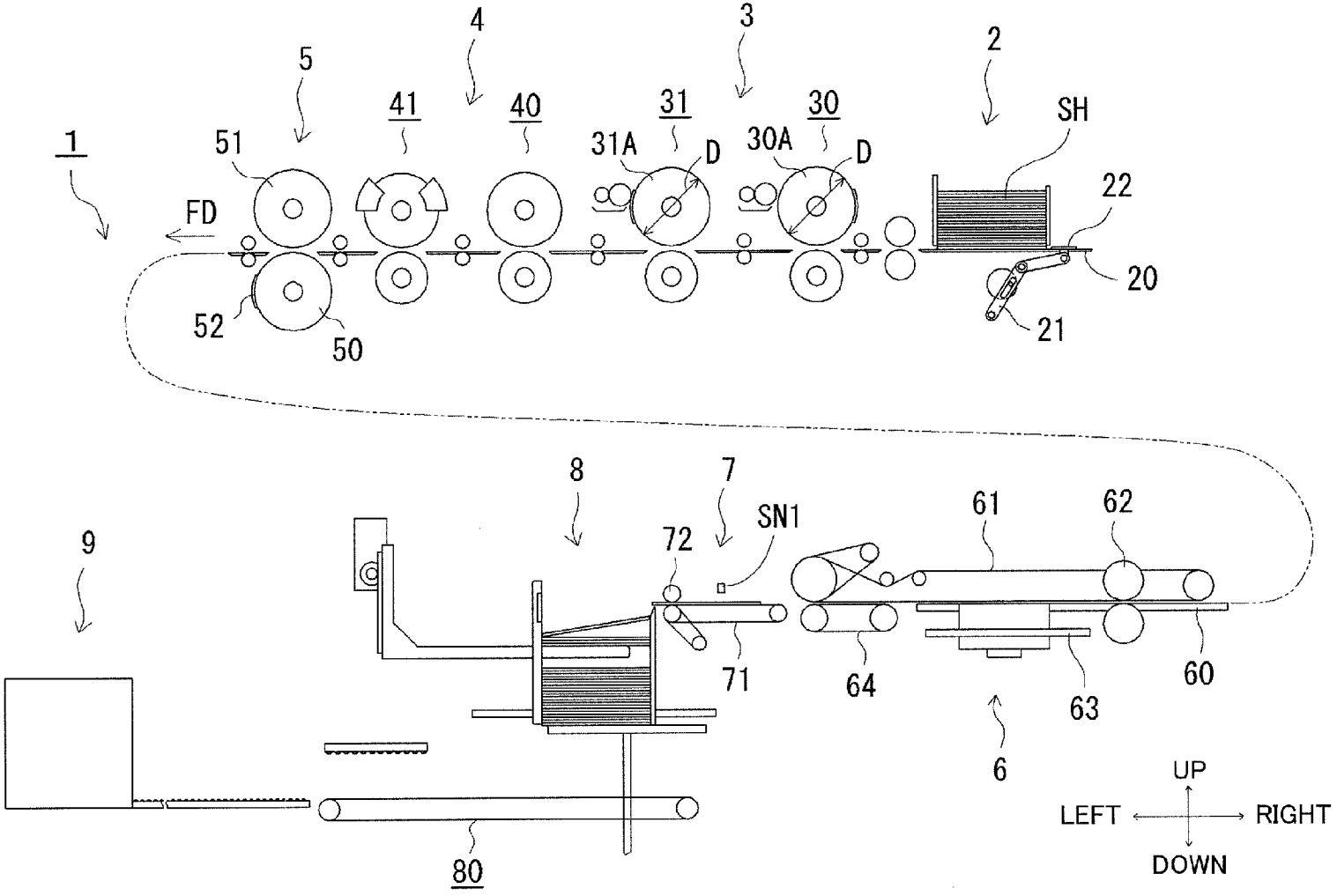
FIG. 1 is a front view illustrating a corrugated paperboard box making machine to which a sheet stacking apparatus (counter-ejector) according to one embodiment of the present invention is applied.

As illustrated in FIG. 1, a corrugated paperboard box making machine 1 comprises: a sheet feeding device 2 for feeding a plurality of corrugated paperboard sheets SH one-by-one; a printing device 3 for printing the fed corrugated paperboard sheet SH; a slotter-creaser 4 for creasing and slotting the printed corrugated paperboard sheet SH, and further cutting-out to form a joint flap; and a die cutter 5 for forming a punched-out portion having a given shape in the creased, slotted and cut-out corrugated paperboard sheets SH. The corrugated paperboard box making machine 1 further comprises: a folder-gluer 6 for applying glue onto the joint flap and then folding and gluing the glue-applied corrugated paperboard sheet SH along the creases and through the joint flap to form a box structure; a sheet transfer device 7; a counter-ejector 8 for counting the number of resulting folded and glued corrugated paperboard sheets SH to form a batch consisting of a given number of the folded and glued corrugated paperboard sheets SH, and ejecting the batch therefrom; and a bundler 9 for bundling the batch together.

The sheet feeding device 2 comprises a table 20 on which a large number of corrugated paperboard sheets SH produced by a corrugating machine are placed. The sheet feeding device 2 also comprises a kicker 22 configured to be reciprocatingly moved by a crank lever mechanism 21. The kicker 22 is operable to knick out a lowermost one of the large number of corrugated paperboard sheets SH to thereby feed the corrugated paperboard sheets SH one-by-one to the printing device 3. The crank lever mechanism 21 is drivenly coupled to a main drive motor MT.

The printing device 3 comprises a plurality of printing units 30, 31. Each of the printing units is primarily comprised of: a printing cylinder, called "plate cylinder"; a printing die member; an ink applicator; and a pressure roll. The printing die member is attached to an outer peripheral surface of the printing cylinder. The ink applicator is equipped with an inking roll for applying ink which is changed in color for each of the printing units. The printing device 3 makes two-color printing on the fed corrugated paperboard sheet SH by using the two printing units 30, 31, and supplies the printed corrugated paperboard sheet SH to the slotter-creaser 4. Each of the printing units 30, 31 is drivenly coupled to the main drive motor MT. The printing cylinders 30A, 31A of the two printing units 30, 31 have the same diameter D.

The slotter-creaser 4 comprises a creaser unit 40 and a slotter unit 41. The creaser unit 40 is equipped with a pair of creasing rolls arranged one above the other, in order to perform creasing. The slotter unit 41 is equipped with an upper slotter to which a slotter blade is attached, and a lower slotter formed with a groove fittable with the slotter blade, in order to perform slotting. The slotter-creaser 4 creases and slots the printed corrugated paperboard sheet SH, and further cutting-out the sheet SH to form a joint flap, by using the creaser unit 40 and the slotter unit 41, and supplies the punched corrugated paperboard sheet SH to the die cutter 5. Each of the creaser unit 40 and the slotter unit 41 is drivenly coupled to the main drive motor MT.

The die cutter 5 comprises a die cylinder 50, and an anvil cylinder 51 which are disposed across a conveyance path. A punching die 52 for punching the creased, slotted and cut-out corrugated paperboard sheet SH is attached to a plate-like body made of veneer-core plywood or the like, and the resulting plate-like body is wound around an outer peripheral surface of the die cylinder 50. The anvil cylinder 51 is disposed at a position opposed to the die cylinder 50 across the conveyance path, and coupled to the main drive motor MT via a heretofore-known driving force transmission mechanism in such a manner as to be rotated according to rotation of the main drive motor MT. The punching die 52 punches the creased, slotted and cut-out corrugated paperboard sheet SH being continuously conveyed, to form a hole at a desired position thereof. During order change, the punching die 52 can be replaced with another punching die having a punching pattern conforming to a new order. Each of the die cylinder 50 and the anvil cylinder 51 is drivenly coupled to the main drive motor MT.

The folder-gluer 6 is operable to convey the punched corrugated paperboard sheet SH, and during the conveyance, apply glue onto the joint flap and then fold and glue the glue-applied corrugated paperboard sheet SH along the creases or the like and through the joint flap. The folder-gluer 6 comprises a guide rail 60 along a conveyance direction FD of the corrugated paperboard sheet SH. A loop-shaped conveyance belt 61 is circulatingly movably provided just above the guide rail 60. A glue supply device 62, a bending bar 63 and a folding belt 64 are arranged along the guide rail 60 and the conveyance belt 61.

The folder-gluer 6 is operable to support and convey the punched corrugated paperboard sheet SH formed with the creases and the joint flap, by using the guide rail 60 and the conveyance belt 61. During the conveyance of the punched corrugated paperboard sheet SH, the folder-gluer 6 is operable to apply glue onto the joint flap by using the glue supply device 62, and then bend the glue-applied corrugated paperboard sheet SH by using the bending bar 63. Then, the folder-gluer 6 is operable to fold the bent corrugated paperboard sheet SH and glue the folded corrugated paperboard sheet SH through the joint flap, by using the folding belt 64 and, thereby preparing a folded and glued corrugated paperboard sheet SH. The conveyance belt 61 is drivenly coupled to a conveyance drive motor MF1, and the folding belt 64 is drivenly coupled to a folding drive motor MF2.

The sheet transfer device 7 is primarily comprised of a transfer conveyer 71 and an upper conveyance roll 72. The transfer conveyer 71 is operable to receive the folded and glued corrugated paperboard sheet SH from the folder-gluer 6 and convey the received corrugated paperboard sheet SH. The upper conveyance roll 72 is disposed above and in opposed relation to the transfer conveyer 71, at a position on an outlet side of the transfer conveyer 71. The upper conveyance roll 72 is operable to nip the corrugated paperboard sheet SH in cooperation with the transfer conveyer 71, and convey the corrugated paperboard sheet SH toward the counter-ejector 8. Each of the transfer conveyer 71 and the upper conveyance roll 72 is drivenly coupled to a conveyer drive motor MS.

The counter-ejector 8 is operable to count the number of the corrugated paperboard sheets SH sequentially stacked from the sheet transfer device 7 to form a batch BT consisting of a given number of the corrugated paperboard sheets SH, and eject the batch BT toward the bundler 9 by a lower conveyer 80. A detailed configuration of the counter-ejector 8 will be described later.

The bundler 9 is operable to bundle the batch BT conveyed by the lower conveyer 80, for transportation. The bundler 9 has a well-known configuration.

<Counter-Ejector>

Figure 2:
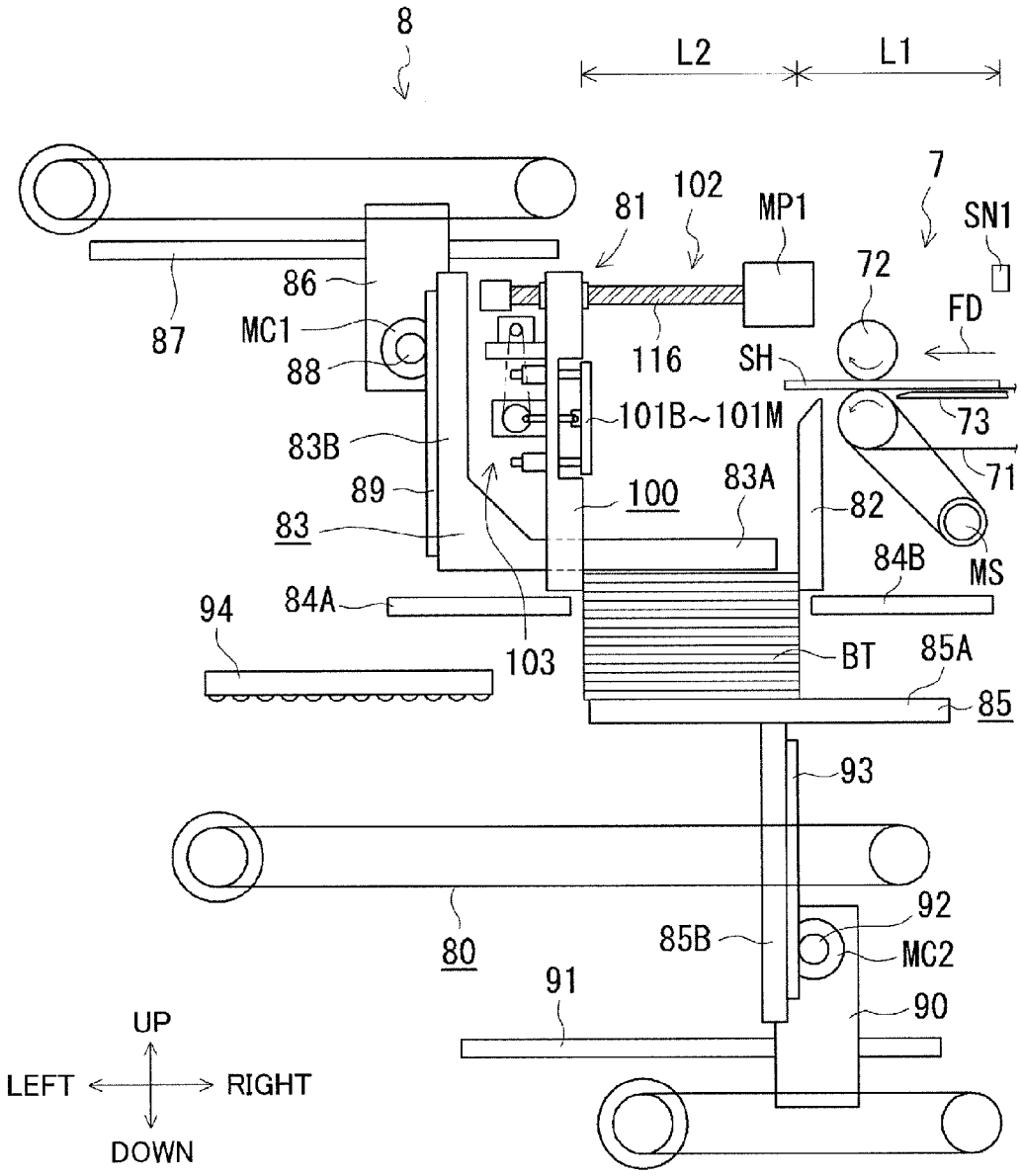
FIG. 2 is a front view illustrating the counter-ejector according to the above embodiment.

As illustrated in FIG. 2, the counter-ejector 8 is primarily comprised of a lower conveyer 80, a leading-edge regulating mechanism 81, a correction plate 82, a main ledge 83, a pair of auxiliary ledges 84A, 84B, and an elevator 85. A basic configuration of the counter-ejector 8 has heretofore been known, as described, for example, in JP-2011-230432A. Thus, only a part of the counter-ejector 8 structurally and operationally associated with the leading-edge regulating mechanism 81 will be described here.

The leading-edge regulating mechanism 81 is operable to set a position of a leading-edge regulating member 100 in a right-left direction, in such a manner as to allow the leading-edge regulating member 100 to come into contact with a leading edge of the corrugated paperboard sheet SH conveyed and stacked in the given conveyance direction FD by the sheet transfer device 7. A detailed configuration of the leading-edge regulating mechanism 81 will be described later.

The correction plate 82 is located adjacent to and in a certain positional relationship with the sheet transfer device 7, and disposed to come into contact with a trailing edge of the corrugated paperboard sheet SH. A plurality of the corrugated paperboard sheets SH are stacked in a receiving space defined by the leading-edge regulating member 100, the correction plate 82 and others.

The main ledge 83 has an L shape, and comprises a plurality of branched horizontally-extending portions 83A and a vertically-standing portion 83B. A ledge support member 86 is supported by a guide rail 87 movably in the right-left direction. The ledge support member 86 is disposed in such a manner as to be displaceable in the right-left direction by using a heretofore-known position adjustment mechanism. A ledge lifting-lowering motor MC1 is fixed onto the ledge support member 86. A pinion 88 is fixed to an output shaft of the ledge lifting-lowering motor MC1. A rack 89 is fixed to the vertically-standing portion 83B of the main ledge 83. The rack 89 is meshed with the pinion 88. The vertically-standing portion 83B of the main ledge 83 is supported by a support mechanism installed in the ledge support member 86, in an upwardly and downwardly movable manner. The main ledge 83 is configured to be positioned in an up-down direction according to a rotational direction and a rotational amount of the ledge lifting-lowering motor MC1.

The auxiliary ledge 84A is disposed in such a manner as to be movable forwardly and backwardly with respect to the leading-edge regulating member 100 and in the right-left direction. The auxiliary ledge 84B is disposed in such a manner as to be movable forwardly and backwardly with respect to the correction plate 82 and in the right-left direction. The auxiliary ledges 84A, 84B are configured to be moved in respective directions causing them to come closer to each other, thereby supporting a lower surface of the stacked corrugated paperboard sheet SH, and then to be moved in respective directions causing them to come away from each other, thereby passing the stacked corrugated paperboard sheet SH to the elevator 85. Each of the auxiliary ledges 84A, 84B is coupled to a non-illustrated ledge drive motor via a heretofore-known coupling mechanism.

The elevator 85 comprises a table 85A on an upper side thereof, and a support rod 85B on a lower side thereof. An elevator support member 90 is supported by a guide rail 91 movably in the right-left direction. The elevator support member 90 is disposed in such a manner as to be displaceable in the right-left direction by using a heretofore-known position adjustment mechanism. An elevator lifting-lowering motor MC2 is fixed onto the elevator support member 90. A pinion 92 is fixed to an output shaft of the elevator lifting-lowering motor MC2. A rack 93 is fixed to the support rod 85B of the elevator 85. The rack 93 is meshed with the pinion 92. The support rod 85B of the elevator 85 is supported by a support mechanism installed in the elevator support member 90, in an upwardly and downwardly movable manner. The elevator 85 is configured to be positioned in the up-down direction according to a rotational direction and a rotational amount of the elevator lifting-lowering motor MC2.

The lower conveyer 80 is coupled to a non-illustrated belt drive motor via a heretofore-known coupling mechanism. An upper conveyer 94 is disposed in spaced-apart relation to the lower conveyer 80 by a given distance. The upper conveyer 94 is configured to be moved in the up-down direction by a non-illustrated servomotor, and positioned with respect to the lower conveyer 80, in such a manner as to allow the distance between the upper conveyer 94 and the lower conveyer 80 to become approximately equal to an up-down directional thickness of the batch BT. The upper conveyer 94 is coupled to a non-illustrated belt drive motor via a heretofore-known coupling mechanism. The lower conveyer 80 is operable to eject the batch BT to the bundler 9 in cooperation with the upper conveyer 94.

<Leading-Edge Regulating Mechanism>

Figure 3:
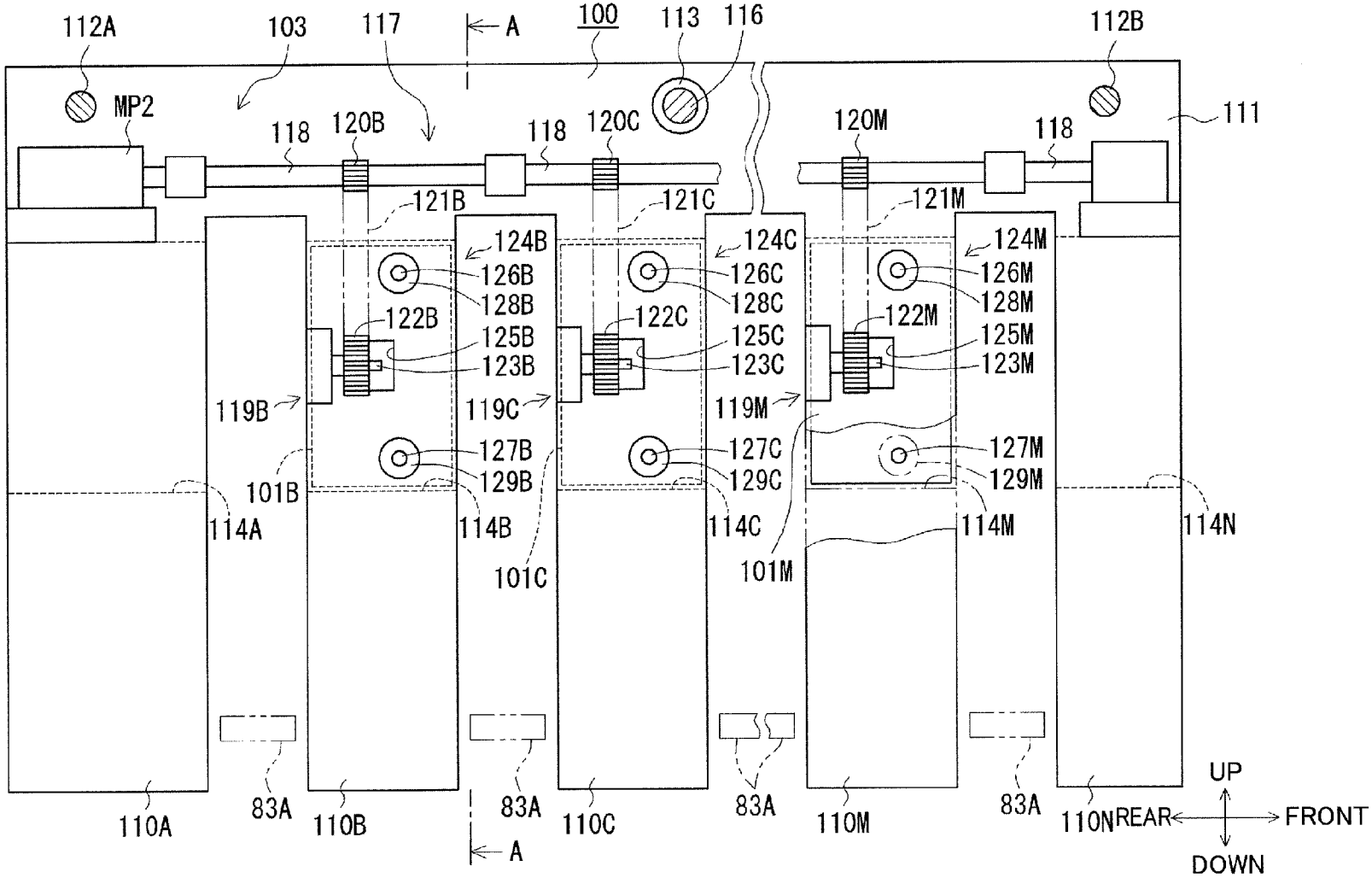
FIG. 3 is a left side view illustrating a leading-edge regulating mechanism in the counter-ejector.
Figure 4:
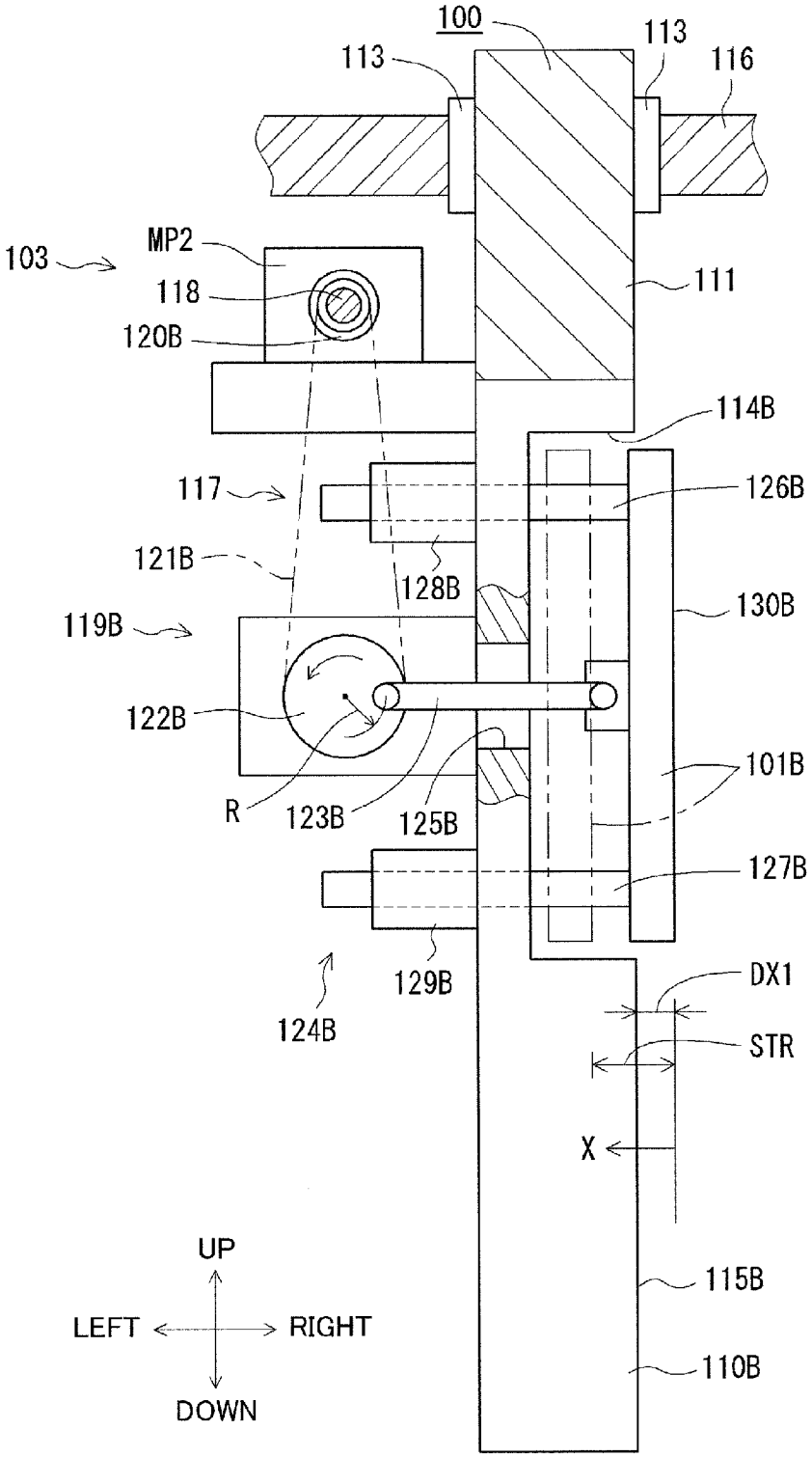
FIG. 4 is an enlarged front view illustrating the leading-edge regulating mechanism in a state in which a sheet stopper of the leading-edge regulating mechanism is kept in a standby state at a first position.

With reference to FIGS. 2 to 4, the leading-edge regulating mechanism 81 will be described in detail. First of all, as illustrated in FIG. 2, the leading-edge regulating mechanism 81 is primarily comprised of the leading-edge regulating member 100, a plurality of sheet stoppers 101B, 101C, 101M, a positioning mechanism 102, and a reciprocating mechanism 103. The positioning mechanism 102 is designed to set a position of the leading-edge regulating member 100 by moving the leading-edge regulating member 100 in the right-left direction. The reciprocating mechanism 103 is designed to reciprocatingly move the plurality of sheet stoppers 101B to 101M in the right-left direction on the leading-edge regulating member 100.

(Leading-Edge Regulating Member)

With reference to FIGS. 3 and 4, the leading-edge regulating member 100 will be described. As illustrated in FIG. 3, the leading-edge regulating member 100 comprises a plurality of support portions 110A, 110B, 110C, 110M, 110N, and a frame 111 to which the support portions 110A to 110N are fixed. The support portions 110A to 110N are arranged to extend downwardly from the frame 111, with a given distance (interspace) between adjacent ones of them in a front-rear direction. The given distance between adjacent ones of the support portions 110A to 110N is set to allow a corresponding one of the horizontally-extending portions 83A of the main ledge 83 to be penetratingly inserted thereinto.

The frame 111 is supported by a plurality of guide shafts 112A, 112B in such a manner as to be movable in the right-left direction. The frame 111 comprises at least one internally-threaded nut portion 113. Each of the support portions 110A to 110N has a recess (114A, 114B, 114C, 114M, 114N), and a contact surface. For example, referring to FIG. 4, the support portion 110B has a right surface serving as a contact surface 115B, wherein a recess 114B is formed in the right surface. The plurality of contact surfaces including the contact surface 115B are arranged in such a manner as to be contactable with respective leading edges of the corrugated paperboard sheets SH stacked on the horizontally-extending portions 83A of the main ledge 83.

(Positioning Mechanism)

The positioning mechanism 102 is primarily comprised of at least one externally-threaded shaft 116, and a positioning motor MP1. The externally-threaded shaft 116 is horizontally supported by a stationary frame of the counter-ejector 8, in a posture where it extends in the right-left direction. The externally-threaded shaft 116 is screwed with the internally-threaded nut portion 113 of the leading-edge regulating member 100. The positioning motor MP1 is coupled to the externally-threaded shaft 116 directly or via a coupling gear mechanism. The positioning motor MP1 is operable to rotationally drive the externally-threaded shaft 116 to thereby set the position of the leading-edge regulating member 100 in such a manner as to allow a distance (interspace) between the leading-edge regulating member 100 and the correction plate 82 to correspond to a length of the corrugated paperboard sheet SH in the conveyance direction FD.

(Reciprocating Mechanism)

As illustrated in FIGS. 3 and 4, the reciprocating mechanism 103 is primarily comprised of a drive motor MP2, and a transmission mechanism 117. The drive motor MP2 is fixed to fixed to a rearward end of the frame 111. The transmission mechanism 117 comprises a drive shaft 118, and a plurality of conversion mechanisms 119B, 119C, 119M. The drive shaft 118 is disposed to extend in the front-rear direction, and horizontally supported by the frame 110. The drive shaft 118 is coupled to a rotary shaft of the drive motor MP2.

Each of the conversion mechanisms 119B to 119M is operable to convert a rotational motion of the drive shaft 118 to a linear motion of a corresponding one of the sheet stoppers 101B to 101M. Each of the conversion mechanisms 119B to 119M comprises a toothed drive pulley, a transmission belt, a toothed rotor, a coupling rod, and a guide mechanism. For example, referring to FIG. 4, the conversion mechanism 119B comprises a toothed drive pulley 120B, a transmission belt 121B, a toothed rotor 122B, a coupling rod 123B, and a guide mechanism 124B. Each of the conversion mechanisms 119B to 119M has the same configuration. Thus, they will be described in detail by taking the conversion mechanism 119B as an example.

The toothed drive pulley 120B is fixed onto the drive shaft 118. The toothed rotor 122B has a diameter greater than that of the toothed drive pulley 120B, and is rotatably supported with respect to a left surface of the support portion 110B. The transmission belt 121B is wound between the toothed drive pulley 120B and the toothed rotor 122B in a tensioned state. The support portion 110E has a through-hole 125B for allowing the coupling rod 123B to be penetratingly inserted. The coupling rod 123B couples a coupling site provided on the toothed rotor 122B at a position adjacent to an outer peripheral surface thereof, and a coupling site provided on a left surface of the sheet stopper 101B, together, while being penetratingly inserted into the through-hole 125B. The radius R illustrated in FIG. 4 is a distance between a rotational center of the toothed rotor 122B, and the coupling site between the toothed rotor 122B and the coupling rod 123B.

The guide mechanism 124B comprises a pair of support shafts 126B, 127B, and a pair of bearing portions 128B, 129B. Each of the support shafts 126B, 127B is disposed to extend horizontally from the left surface of the sheet stopper 101B. Each of the bearing portions 128B, 129B is fixed to the left surface of the support portion 110B, and supports a corresponding one of the support shafts 126B, 127B slidably in the right-left direction.

(Sheet Stopper)

The sheet stoppers 101B, 110C, 101M are installed, respectively, in the support portions 110B, 110C, 110M. Each of the sheet stoppers 101B to 101M has the same structure. Thus, they will be described in detail by taking the sheet stopper 101B as an example.

The sheet stopper 101B is formed in a flat plate shape having a width approximately equal to a width of the support portion 110B in the front-rear direction. Referring to FIG. 2, the sheet stopper 101B is formed to have a given length in the up-down directional, and disposed to extend downwardly beyond a height position where the transfer conveyer 71 and the upper conveyance roll 72 of the sheet transfer device 7 are installed. The given length is set to allow the leading edge of the corrugated paperboard sheet SH stacked from the sheet transfer device 7 into the receiving space between the leading-edge regulating member 100 and the correction plate 82 to reliably come into contact with the sheet stopper 101B, irrespective of the length of the corrugated paperboard sheet SH in the conveyance direction FD, in a state illustrated in FIG. 2.

The sheet stopper 101B has a flat contact surface 130B. In FIG. 4, the solid lines indicate a state in which the contact surface 130B of the sheet stopper 101B is located at a first position where it is moved maximally forwardly (rightwardly) from the contact surface 115B of the support portion 110B. At the first position, the contact surface 130B protrudes from the contact surface 115B by a given distance DX1. On the other hand, in FIG. 4, the two-dot chain lines indicate a state in which the contact surface 130B of the sheet stopper 101B is located at a second position where it is moved maximally backwardly (leftwardly) from the contact surface 115B of the support portion 110B. At the second position, the contact surface 130B is moved backwardly from the contact surface 115B by a distance obtained by subtracting the distance DX1 from a distance STR equal to two times of the radius R. That is, the sheet stopper 101B is configured to be reciprocatingly moved between the first position and the second position, with a stroke of the distance STR.

The toothed drive pulleys 120B, 120C, 120M are coupled, respectively, to the toothed rotors 122B, 122C, 122M via the transmission belts 121B, 121C, 121M, in such a manner as to allow respective positions of the sheet stoppers 101B to 101M in the right-left direction to be always coincident with each other. For example, the toothed drive pulleys are coupled, respectively, to the toothed rotors, in such a manner as to allow the sheet stoppers 101B to 101M to be simultaneously located at the first position illustrated in FIG. 4. This makes it possible to reciprocatingly move the sheet stoppers 101B to 101M, while allowing the respective positions of the sheet stoppers 101B to 101M in the right-left direction to be always coincident with each other.

<Detector>

A leading-edge detector SN1 is disposed above the transfer conveyer 71. The leading-edge detector SN1 is operable to detect a passing of each of the corrugated paperboard sheets SH being conveyed by the transfer conveyer 71. In this embodiment, the leading-edge detector SN1 is composed of an optical sensor configured to emit light toward the transfer conveyer 71 and detect light reflected by the corrugated paperboard sheets SH being conveyed. Referring to FIG. 2, the leading-edge detector SN1 is disposed at a position away from a left surface of the correction plate 82 contactable with the stacked corrugated paperboard sheets SH, on an upstream side in the conveyance direction FD by a given distance L1. Generally, the correction plate 82 is configured to perform an oscillatory movement in the right-left direction with a constant period and a constant amplitude to thereby align rear ends of the stacked corrugated paperboard sheets SH. In this case, the given distance L1 is a distance from the left surface of the correction plate 82 in a state when it is moved to a leftmost position during the oscillatory movement. The distance L2 illustrated in FIG. 2 is a distance between the left surface of the correction plate 82, and a right surface of the leading-edge regulating member 100, and is equivalent to the length of the corrugated paperboard sheet SH in the conveyance direction FD.

A rotation detector SN2 is coupled to a rotary shaft of the positioning motor MP1. The rotation detector SN2 is operable to generate rotation pulses in a number corresponding to a rotation amount of the rotary shaft of the positioning motor MP1. The rotation pulses from the rotation detector SN2 are used to set the position of the leading-edge regulating member 100 in the right-left direction.

A rotation detector SN3 is coupled to the rotary shaft of the drive motor MP2. The rotation detector SN3 is operable to generate rotation pulses in a number corresponding to a rotation amount of the drive motor MP2. The rotation pulses from the rotation detector SN3 are used to allow each of the sheet stoppers 101B to 101M to be reciprocatingly moved according to a given speed pattern.

<<Electrical Configuration>>

Figure 5:
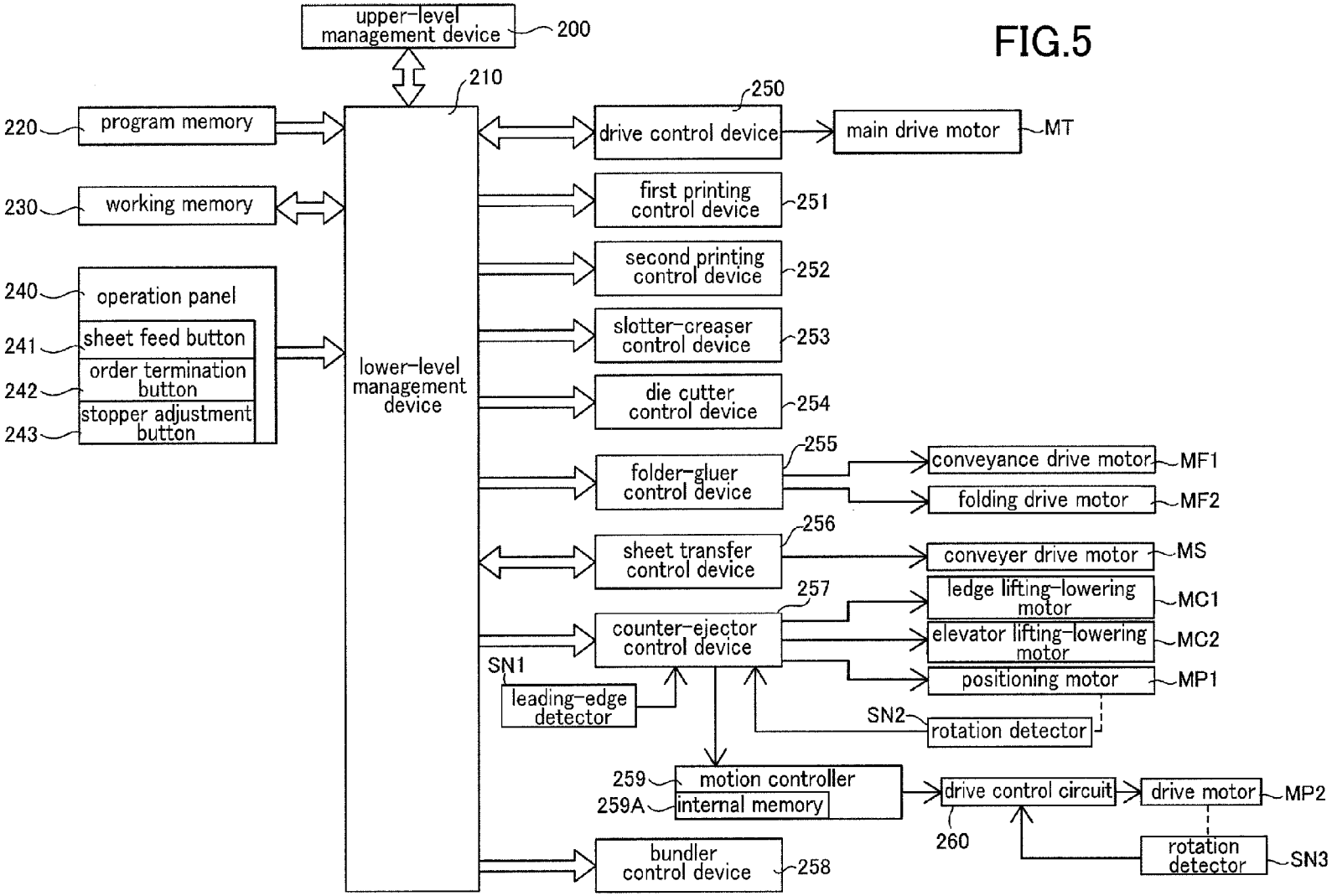
FIG. 5 is a block diagram illustrating an electrical configuration of the corrugated paperboard box making machine.

With reference to FIG. 5, an electrical configuration of the corrugated paperboard box making machine 1 will be described. An upper-level management device 200 and a lower-level management device 210 are provided to generally manage processing of corrugated paperboard sheets in the corrugated paperboard box making machine 1. The upper-level management device 200 stores therein a production management plan for executing a large number of orders in a predetermined sequence. The upper-level management device 200 is operable to transmit control instruction information regarding a rotational speed of the main drive motor MT, a size of a corrugated paperboard sheet SH, the number of corrugated paperboard sheets to be processed, etc., to the lower-level management device 210, for each order.

The lower-level management device 210 is operable, according to the control instruction information transmitted from the upper-level management device 200, to control operations of drive sections such as the main drive motor MT, and perform a management control, for example, of counting the number of processed corrugated paperboard sheets and transmitting the obtained data to the upper-level management device 200. The lower-level management device 210 is connected to a program memory 220 and a working memory 230, thereby making up a computer for controlling the corrugated paperboard box making machine 1 in cooperation with these memories. The program memory 220 is designed to fixedly store therein a control program for controlling the entire corrugated paperboard box making machine 1, given set values, etc. The working memory 230 is designed to temporarily store therein a variety of information transmitted from the upper-level management device 200 and calculation results, during execution of the control program.

The lower-level management device 210 is connected to an operation panel 240. The operation panel 240 has a sheet feed button 241, an order termination button 242, and a stopper adjustment button 243. The sheet feed button 241 is configured to be manually operated to start feeding of corrugated paperboard sheets SH from the sheet feeding device 2. The order termination button 242 is configured to be manually operated to terminate a currently executed order. The stopper adjustment button 243 is configured to be manually operated to set each of the sheet stoppers 101B to 101M to the first position.

The lower-level management device 210 is connected to each of a drive control device 250, first and second printing control devices 251, 252, a slotter-creaser control device 253, a die cutter control device 254, a folder-gluer control device 255, a sheet transfer control device 256, a counter-ejector control device 257, and a bundler control device 258. The drive control device 250 is operable, according to the control instruction information from the lower-level management device 210, to control activation and deactivation of the main drive motor MT, and the rotational speed thereof. Each of the first and second printing control devices 251, 252 is operable, according to the control instruction information from the lower-level management device 210, to control an operation of a respective one of the printing units 30, 31. The slotter-creaser control device 253 is operable, according to the control instruction information from the lower-level management device 210, to control operations of the creaser unit 40 and the slotter unit 41. The die cutter control device 254 is operable, according to the control instruction information from the lower-level management device 210, to control an operation of the die cutter 5.

The folder-gluer control device 255 is operable, according to the control instruction information from the lower-level management device 210, to control activation and deactivation of each of the conveyance drive motor MF1, the folding drive motor MF2 and other drive motors used for the folder-gluer 6, and rotational speeds thereof. The sheet transfer control device 256 is operable, according to the control instruction information from the lower-level management device 210, to control activation and deactivation of the conveyer drive motor MS, and a rotational speed thereof. The counter-ejector control device 257 is operable to receive a leading-edge detection signal from the leading-edge detector SN1, and the rotation pulses from the rotation detector SN2, and then, according to the control instruction information from the lower-level management device 210, leading-edge detection signal and the rotation pulses, to control activation and deactivation of each of the ledge lifting-lowering motor MC1, the elevator lifting-lowering motor MC2, the positioning motor MP1, and other drive motors used for the counter-ejector 8, and rotational speeds thereof. The bundler control device 258 is operable, according to the control instruction information from the lower-level management device 210, to control an operation of the bundler 9.

The counter-ejector control device 257 is operable, according to the leading-edge detection signal from the leading-edge detector SN1, to supply a motion activation instruction to a motion controller 259, and supply the control instruction information from the lower-level management device 210 to the motion controller 259. The motion controller 259 comprises an internal memory 259A storing therein programs. The internal memory 259A preliminarily stores therein a speed-pattern creation program for creating an aftermentioned speed pattern, and a position-instruction creation program for creating position instructions according to the created speed pattern. The motion controller 259 is operable, in response to receiving the motion activation instruction, to execute the position-instruction creation program. Then, the motion controller 259 is operable, based on execution of the position-instruction creation program, to generate a position instruction every given control cycle. For example, the given control cycle is 1 msec, which is a time period sufficiently less than a time period during which the rotary shaft of the drive motor MP2 is rotated 360 degrees at a maximum rotational speed. A basis configuration of the motion controller 259 is commonly known, as disclosed, for example, in JP 2006-072399A, JP 11-272312A and JP 05-050329A. Thus, its detailed description will be omitted.

Further, the counter-ejector control device 257 is operable, every time the stopper adjustment button 243 of the operation panel 240 is manually operated, to receive a stopper adjustment instruction from the lower-level management device 210, and supply the stopper adjustment instruction to the motion controller 259. The motion controller 259 is operable, every time it receives the stopper adjustment instruction, to supply a rotation instruction for rotating the drive motor MP2 by a certain amount, to the drive control circuit 260.

The drive control circuit 260 is operable to receive the position instruction from the motion controller 259, and the rotation pulses from the rotation detector SN3, and control the rotation amount of the drive motor MP2, and activation and deactivation of the drive motor MP2. That is, the drive control circuit 260 is operable to control a supply electricity to the drive motor MP2, in such a manner as to allow a rotation amount by which the drive motor MP2 is rotated during the given control cycle, to become equal to an instructed rotation amount conforming to the position instruction. In conjunction with rotation of the drive motor MP2, the toothed rotor 122B is rotated in a counterclockwise direction indicated by the arrowed lines in FIG. 4. In this embodiment, the rotation detector SN3 is configured to be capable of generating a large number of rotation pulses, e.g., 1000 pulses/msec, during the given control cycle.

<Speed Pattern>

Figures 6A, 6B, 6C, 6D:
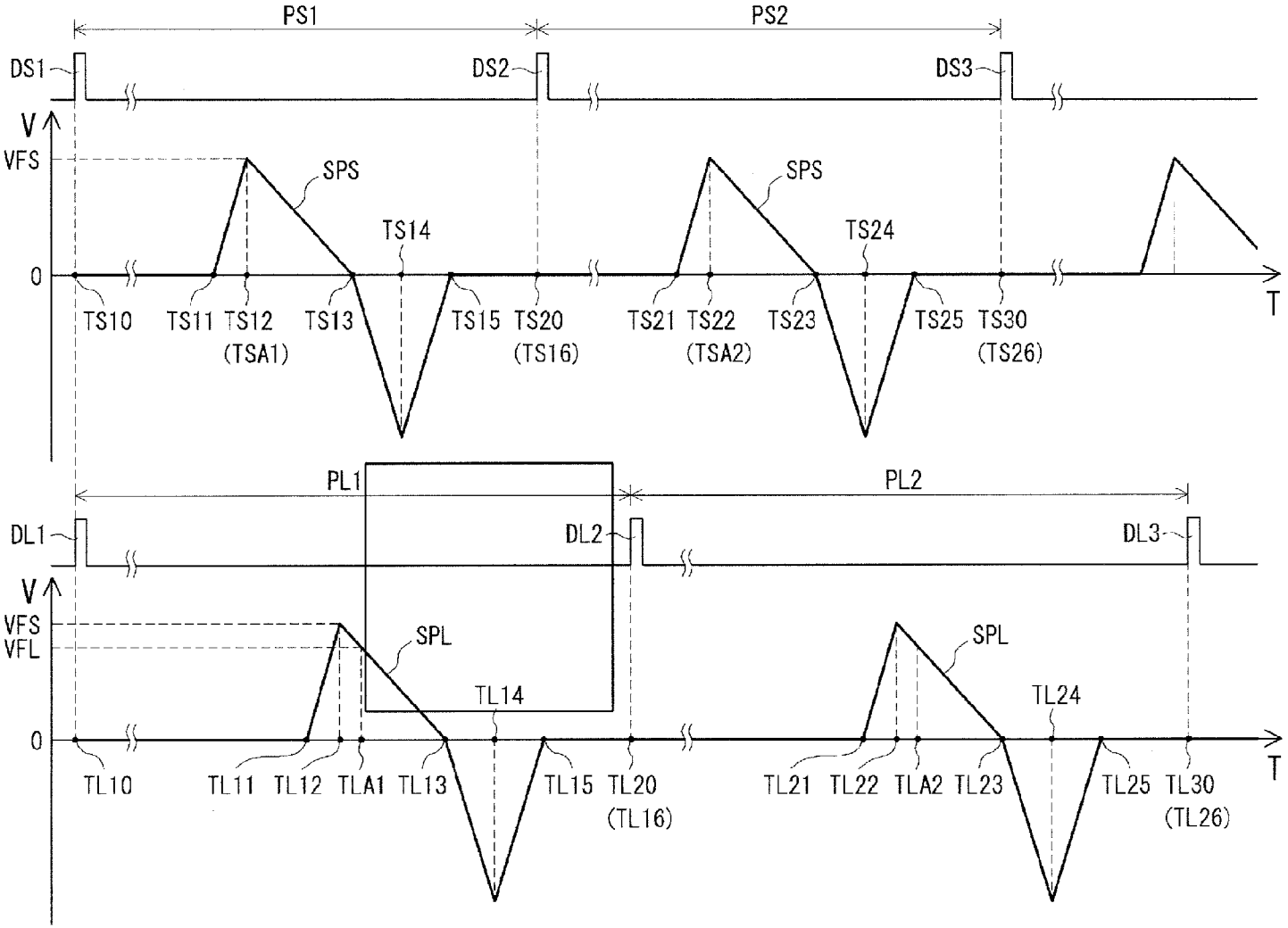
FIGS. 6(A) and 6(B) are time charts illustrating, respectively, a leading-edge detection signal (DS1 to DS3) and a speed pattern SPS, in the case where a length of a corrugated paperboard sheet SH is relatively short.
FIGS. 6(C) and 6(D) are time charts illustrating, respectively, a leading-edge detection signal (DL1 to DL3) and a speed pattern SPL, in the case where the length of the corrugated paperboard sheet SH is relatively long.

With reference to FIGS. 6(A) to 6(D), a speed pattern, i.e., a pattern of the movement speed during the reciprocating motion of the sheet stoppers 101B to 101M, will be described. FIGS. 6(A) and 6(B) illustrate, respectively, a leading-edge detection signal (DS1 to DS3) generated by the leading-edge detector SN1, and a speed pattern SPS, in the case where a length of the corrugated paperboard sheet SH in the conveyance direction FD is relatively short. FIGS. 6(C) and 6(D) illustrate, respectively, a leading-edge detection signal (DL1 to DL3) generated by the leading-edge detector SN1, and a speed pattern SPL, in the case where the length of the corrugated paperboard sheet SH in the conveyance direction FD is relatively long. In FIGS. 6(B) and 6(D), the vertical axis represents a movement speed V of the sheet stoppers, and the horizontal axis represents an elapsed time T. Further, the conveyance (transfer) speed VFS means a conveyance (transfer) speed of the short-type corrugated paperboard sheet SH, and the conveyance speed VFL means a conveyance speed of the long-type corrugated paperboard sheet SH. Generally, as a corrugated paperboard sheet SH has a longer length, the conveyance speed thereof is set to a lower value, in many cases. Thus, the conveyance (transfer) speed VFL is set to a value less than the conveyance speed VFS. In this embodiment, the conveyance speed VFS is a maximum conveyance speed at which the corrugated paperboard box making machine 1 can convey the corrugated paperboard sheet SH. In this embodiment, the length of the short-type corrugated paperboard sheet SH in the conveyance direction FD is 450 mm, and the length of the long-type corrugated paperboard sheet SH in the conveyance direction FD is 850 mm.

(Speed Pattern SPS for Short-Type Corrugated Paperboard Sheet SH)

In FIGS. 6(A) and 6(B), at time TS10 when a passing of a leading edge of a first one of the short-type corrugated paperboard sheets SH is detected by the leading-edge detector SN1, a leading-edge detection signal DS1 is generated. At time TS20 (TS16) when a passing of a leading edge of a second one of the short-type corrugated paperboard sheets SH is detected by the leading-edge detector SN1, a leading-edge detection signal DS2 is generated. A speed pattern SPS in a time period PS1 between the time TS10 and the time TS20 (TS16) indicates a change in the movement speed V of the sheet stoppers during the time period PS1. Similarly, at time TS30 (TS26) when a passing of a leading edge of a third one of the short-type corrugated paperboard sheets SH is detected by the leading-edge detector SN1, a leading-edge detection signal DS3 is generated. A speed pattern SPS in a time period PS2 between the time TS20 (TS16) and the time TS30 (TS26) is the same as the speed pattern SPS in the time period PS1.

From time TS11 when the sheet stoppers start moving from the first position, the movement speed V of the sheet stoppers is increased at a given acceleration. Then, at time TS12, the movement speed V reaches the conveyance speed VFS. An acceleration of the movement speed V, in the time period between the time TS11 and the time TS12, is a maximum acceleration which is determined depending on an output capacity of the drive motor MP2. In a time period between the time TS12 and time TS13 when the sheet stoppers reach the second position, the movement speed V is reduced at a possibly small negative acceleration. This makes it possible to extend a deceleration time period of the sheet stoppers as long as possible. In a time period between the time TS13 and time TS14 when the sheet stoppers is moved from the second position by the radius R, the movement speed V is increased at the maximum acceleration which is determined depending on the output capacity of the drive motor MP2. Then, in a time period between the time TS14 and time TS15 when the sheet stoppers reach the first position, the movement speed V is reduced at a maximum negative acceleration which is determined depending on the output capacity of the drive motor MP2. In a time period between the time TS15 to the time TS20 (TS16), the sheet stoppers are kept static in a standby state at the first position.

The speed pattern SPS for the short-type corrugated paperboard sheet SH is created to allow the leading edge of the short-type corrugated paperboard sheet SH to come into contact with the sheet stoppers when the movement speed V of the sheet stoppers reaches a maximum movement speed equal to the conveyance speed VFS. Specifically, the speed pattern SPS is preliminarily created such that, referring to FIG. 4, when the sheet stopper 101B is moved leftwardly by the distance DX1, and thereby the contact surface 130B of the sheet stopper 101B becomes flush with the contact surface 115B of the support portion 110B, the leading edge of the short-type corrugated paperboard sheet SH comes into contact with the contact surface 130B of the sheet stopper 101B, and the movement speed V of the sheet stopper 101B at the time of the contact reaches the maximum movement speed equal to the conveyance speed VFS. A distance by which the short-type corrugated paperboard sheet SH is moved in a time period from the time TS10 when a passing of a leading edge of one of the short-type corrugated paperboard sheets SH is detected by the leading-edge detector SN1 through until the time TS12 (TSA1) when the leading edge of the short-type corrugated paperboard sheet SH comes into contact with the contact surface 130B of the sheet stopper 101B is a total distance (L1+L2) of the distance L1 and the distance L2 illustrated in FIG. 2. In this case, the time TS12 when the movement speed V reaches the maximum movement speed is coincident with time TSA1 of the contact. Further, the distance L2 corresponds to a length of the short-type corrugated paperboard sheet SH in the conveyance direction FD. It is considered that a movement speed of the short-type corrugated paperboard sheet SH in a time period from a time when the short-type corrugated paperboard sheet SH is stacked from the sheet transfer device 7 through until the corrugated paperboard sheet SH comes into contact with the contact surface 130B of the sheet stopper 101B is approximately equal to the conveyance speed VFS. Thus, the time period between the time TS10 and the time TS12 (TSA1) is determined by dividing the distance (L1+L2) by the conveyance speed VFS. Further, a time period between the time TS11 and the time TS12 (TSA1) is determined by dividing the conveyance speed VFS by the maximum acceleration which is determined depending on the output capacity of the drive motor MP2. Thus, a time period between the time TS10 and the time TS11 can be calculated based on the distance (L1+L2), the conveyance speed VFS, and the maximum acceleration which is determined depending on the output capacity of the drive motor MP2. A time period of one cycle of the speed pattern SPS, e.g., the time period PS1, is determined based on a distance between respective leading edges of two short-type corrugated paperboard sheets SH being successively conveyed, and the conveyance speed VFS. Thus, when the time period PS1 is determined, the time period between the time TS15 to the time TS20 (TS16) can be determined. Generally, the distance between the leading edges of the two short-type corrugated paperboard sheets SH is equivalent to the diameter D of each of the printing cylinders 30A, 31A. The speed pattern SPS in the time period PS2 is determined in the same manner as that for the speed pattern SPS in the time period PS1.

(Speed Pattern SPL for Long-Type Corrugated Paperboard Sheet SH)

In FIGS. 6(C) and 6(D), at time TL10 when a passing of a leading edge of a first one of the long-type corrugated paperboard sheets SH is detected by the leading-edge detector SN1, a leading-edge detection signal DL1 is generated. At time TL20 (TL16) when a passing of a leading edge of a second one of the long-type corrugated paperboard sheets SH is detected by the leading-edge detector SN1, a leading-edge detection signal DL2 is generated. A speed pattern SPL in a time period PL1 between the time TL10 and the time TL20 (TL16) indicates a change in the movement speed V of the sheet stoppers during the time period PL1. Similarly, at time TL30 (TL26) when a passing of a leading edge of a third one of the long-type corrugated paperboard sheets SH is detected by the leading-edge detector SN1, a leading-edge detection signal DL3 is generated. A speed pattern SPL in a time period PL2 between the time TL20 (TL16) and the time TL30 (TL26) is the same as the speed pattern SPL in the time period PL1.

A part of the speed pattern SPL between time TL11 and time TL15 has the same shape as that of a part of the speed pattern SPS between time TS11 and time TS15. However, the speed pattern SPL is different from the speed pattern SPS, in terms of a time period between the time TL10 and the time TL11, and a time period between the time TL15 and the time TL20 (TL16). Further, time TLA1 when the long-type corrugated paperboard sheet SH comes into contact with the contact surfaces of the sheet stoppers is different from time TL12 when the movement speed V of the sheet stoppers reaches the maximum movement speed equal to the conveyance speed VFS.

The speed pattern SPL for the long-type corrugated paperboard sheet SH is created to allow the leading edge of the long-type corrugated paperboard sheet SH to come into contact with the sheet stoppers when the movement speed V of the sheet stoppers is reduced from the conveyance speed VFS, i.e., the maximum conveyance speed, to reach the conveyance speed VFL. Specifically, the speed pattern SPL is preliminarily created such that, when the sheet stopper 101B is moved leftwardly from the original point (first position) by the distance DX1, and thereby the contact surface 130B of the sheet stopper 101B becomes flush with the contact surface 115B of the support portion 110B, the movement speed V of the sheet stopper 101B reaches the maximum movement speed equal to the conveyance speed VFS, and then, when the sheet stopper 101B is further moved leftwardly from the original point (first position) by the distance DX2, while allowing the movement speed V of the sheet stopper 101B to be reduced down to the conveyance speed VFL less than the maximum movement speed, the leading edge of the long-type corrugated paperboard sheet SH comes into contact with the contact surface 130B of the sheet stopper 101B. A distance by which the long-type corrugated paperboard sheet SH is moved in a time period from the time TL10 when a passing of a leading edge of one of the long-type corrugated paperboard sheets SH is detected by the leading-edge detector SN1 through until the time TLA1 when the leading edge of the long-type corrugated paperboard sheet SH comes into contact with the contact surface 130B of the sheet stopper 101B is a value [L1+L2+(DX2−DX1)] obtained by subtracting the distance DX1 from the distance DX2 and then adding the resulting difference (DX2−DX1) to a total distance (L1+L2) of the distance L1 and the distance L2 illustrated in FIG. 2. In this case, the distance L2 corresponds to a length of the long-type corrugated paperboard sheet SH in the conveyance direction FD. It is considered that a movement speed of the long-type corrugated paperboard sheet SH in a time period from a time when the long-type corrugated paperboard sheet SH is stacked from the sheet transfer device 7 through until the corrugated paperboard sheet SH comes into contact with the contact surface 130B of the sheet stopper 101B is approximately equal to the conveyance speed VFL. Thus, the time period between the time TL10 and the time TLA1 is determined by dividing the value [L1+L2+(DX2−DX1)] by the conveyance speed VFL. Further, a time period between the time TL11 and the time TS12 is determined by dividing the conveyance speed VFS by the maximum acceleration which is determined depending on the output capacity of the drive motor MP2. A time period between the time TL12 to the time TLA1 is determined by subtracting the conveyance speed VFL from the conveyance speed VFS and then dividing the resulting difference (VFS−VFL) by the negative acceleration in the time period between the time TS12 (TSA1) and the time TS13 in the speed pattern SPS. Thus, a time period between the time TL10 and the time TL11 can be calculated based on the distance (L1+L2), the difference (DX2−DX1), the conveyance speed VFL, the maximum acceleration which is determined depending on the output capacity of the drive motor MP2, the negative acceleration in the time period between the time TS12 (TSA1) and the time TS13 in the speed pattern SPS, and the difference (VFS−VFL). A time period of one cycle of the speed pattern SPL, e.g., the time period PL1, is determined based on a distance between respective leading edges of two long-type corrugated paperboard sheets SH being successively conveyed, and the conveyance speed VFL. Thus, when the time period PL1 is determined, the time period between the time TL15 to the time TL20 (TL16) can be determined. Generally, the distance between the leading edges of the two long-type corrugated paperboard sheets SH is equivalent to the diameter D of each of the printing cylinders 30A, 31A. The speed pattern SPL in the time period PL2 is determined in the same manner as that for the speed pattern SPL in the time period PL1.

<<Operation and Function>>

Next, with reference to the drawings, an operation and function of the corrugated paperboard box making machine 1 will be described below. First of all, except for the reciprocating motion of the sheet stoppers 101B to 101M, a general operation of each of the sheet feeding device 2, the bundler 9 and other processing devices provided therebetween in the corrugated paperboard box making machine 1 will be described below.

After supplying electricity to the corrugated paperboard box making machine 1 and before starting to execute a first order, an operator manually operates the stopper adjustment button 243 to position the sheet stoppers 101B to 101M in such a manner as to allow respective positions of the sheet stoppers 101B to 101M in the right-left direction to become coincident with the first position illustrated in FIG. 4. In this embodiment, during a positioning work, the operator visually confirms that at least one of the sheet stoppers 101B to 101M is set the first position. After this confirmation, the operator manually operates the sheet feed button 241 to thereby start execution of the first order.

After the start of the execution of the first order, when the operator manually operates the order termination button 242 to terminate the first order, or when a process of producing corrugated paperboard sheets SH in a given number specified in the first order is completed, operation of the corrugated paperboard box making machine 1 is stopped. During the stop of the operation, each of the control devices 250 to 258 receives control instruction information regarding a new order, from the lower-level management device 210. In order to produce and process a corrugated paperboard sheet SH specified by the new order, according to a size of the specified corrugated paperboard sheet SH, a setting of the sheet feed device 2, and setting of the printing device 3, the bundler 9 and other processing devices therebetween, are changed, and processing members such as the printing die member and the punching die 52 are replaced with suitable ones. As regards the counter-ejector 8, the counter-ejector control device 257 operates to rotationally drive the positioning motor MP1 according to control instruction information indicative of a length of a corrugated paperboard sheet SH in the conveyance direction FD, to position the leading-edge regulating member 100 in such a manner as to allow the distance L2 illustrated in FIG. 2 to become equal to the length of the corrugated paperboard sheet SH in the conveyance direction FD.

After completion of replacement of the processing members, the operator stacks corrugated paperboard sheets SH in the sheet feeding device 2. In this state, when the operator manually operates the sheet feed button 241 of the operation panel 240 to start execution of the new order, in response to the manual operation of the sheet feed button 241, the lower-level management device 210 instructs the drive control device 250 to drive the main drive motor MT, and issues to the drive control device 250 an instruction about a conveyance speed of the corrugated paperboard sheet specified by the new order. Thus, the main drive motor MT is driven at a rotational speed corresponding to the instructed conveyance speed, so that the sheet feeding device 2 starts a sheet feeding operation. Concurrently, the printing device 3, the slotter-creaser 4 and the die cutter 5 are activated according to the driving of the main drive motor MT.

Further, in response to the manual operation of the sheet feed button 241, the lower-level management device 210 instructs the folder-gluer control device 255 to drive the conveyance drive motor MF1 and the folding drive motor MF2 and issues to the folder-gluer control device 255 an instruction about an conveyance speed of the processed corrugated paperboard sheet. Thus, each of the conveyance drive motor MF1 and the folding drive motor MF2 is driven at a rotational speed corresponding to the instructed conveyance speed, so that each of the conveyance belt 61 and the folding belt 64 of the folder-gluer 6 is circulatingly moved.

Furthermore, in response to the manual operation of the sheet feed button 241, the lower-level management device 210 instructs the sheet transfer control device 256 to drive the conveyer drive motor MS, and issues to the sheet transfer control device 256 an instruction about a conveyance speed of the corrugated paperboard sheet SH. Thus, the conveyer drive motor MS is driven at a rotational speed corresponding to the instructed conveyance speed, so that the transfer conveyer 71 is circulatingly moved, and the upper conveyance roll 72 are rotated.

In synchronization with a sheet feed cycle in which the sheet feeding device 2 feeds one corrugated paperboard sheet SH, the printing device 3 and the slotter-creaser 4 operate. As a result, given processings, such as printing, creasing, slotting and punching, are made to the fed corrugated paperboard sheet SH. Subsequently, the processed corrugated paperboard sheet SH is supplied from the die cutter 5 to the folder-gluer 6. The folder-gluer 6 applies glue to the joint flap, and folds and glues the glue-applied corrugated paperboard sheet SH to prepare a folded and glued corrugated paperboard sheet SH.

The lower-level management device 210 issues to the sheet transfer control device 256 an instruction about the same conveyance speed as that for the folder-gluer control device 255, so that the transfer conveyer 71 and the upper conveyance roll 72 convey the corrugated paperboard sheet SH into the counter-ejector 8, at the same conveyance speed as that in the folder-gluer 6.

According to the leading-edge detection signal from the leading-edge detector SN1 configured to detect a passing of each corrugated paperboard sheet SH, the counter-ejector control device 257 counts the number of the corrugated paperboard sheets SH to be stacked from the sheet transfer device 7. The counter-ejector control device 257 controls driving of the ledge lifting-lowering motor MC1 in such a manner as to allow the main ledge 83 to be kept in a standby state at an upper position free from interference with the corrugated paperboard sheet SH stacked from the sheet transfer device 7, until the counted number reaches a given value.

During a time period in which the counter-ejector control device 257 counts the number of the corrugated paperboard sheets SH, the counter-ejector control device 257 receives information regarding the conveyance speed of the transfer conveyer 71, from the lower-level management device 210. When the counted number reaches the given value, the counter-ejector control device 257 controls a start timing of driving the ledge lifting-lowering motor MC1, based on the received conveyance speed information. Through this control, a timing at which the main ledge 83 starts moving downwardly from the standby position is determined.

An operation of the counter-ejector 8 for forming the batch BT from the stacked corrugated paperboard sheets SH is well known, as described, for example, in JP 2011-230432A, and therefore its description will be omitted. The batch BT formed by the counter-ejector 8 is conveyed to the bundler 9, and bundled by the bundler 9.

Next, an operation of causing the sheet stoppers to perform a reciprocating motion will be described in detail. The corrugated paperboard box making machine 1 is capable of sequentially executing a plurality of orders in such a manner as to sequentially make a given processing to a plurality of types of corrugated paperboard sheets SH having different length, while conveying each of them in the conveyance direction FD at a different conveyance speed. For the sake of convenience of explanation, the operation of causing the sheet stoppers to perform a reciprocating motion will be described below, in two cases: one case where an short-sheet order requiring an operation of making a given processing to a relatively short corrugated paperboard sheet SH, while conveying it at the maximum conveyance speed VFS is executed; and the other case where a long-sheet order requiring an operation of making a given process to a relatively long corrugated paperboard sheet SH, while conveying it at the conveyance speed VFL less than the maximum conveyance speed VFS.

<Reciprocating Motion of Sheet Stoppers in Short-Sheet Order>

Before starting execution of the short-sheet order, the counter-ejector control device 257 receives, from the lower-level management device 210, control instruction information including: speed information indicative of the maximum conveyance speed; conveyance speed information as an instruction about the conveyance speed VFS of the short-type corrugated paperboard sheet SH; and sheet size information indicative of the length of the short-type corrugated paperboard sheet SH in the conveyance direction FD, and supplies the received control instruction information to the motion controller 259. In this embodiment, the maximum conveyance speed is equal to the conveyance speed VFS of the short-type corrugated paperboard sheet SH.

The motion controller 259 executes the speed-pattern creation program stored in the internal memory 259A to create a speed pattern SPS according to the speed information indicative of the maximum conveyance speed, the conveyance speed information, and the sheet size information, among the control instruction information, and stores therein the created speed pattern SPS.

In response to operator's manual operation of the sheet feed button 241 in order to execute the short-sheet order, the sheet feed device 2 starts to feed the corrugated paperboard sheets SH one-by-one. Then, when a passing of a leading edge of a first one of the short-type corrugated paperboard sheets SH to which given processings are made is detected by the leading-edge detector SN1, the leading-edge detection signal DS1 illustrated in FIG. 6(A) is generated. In response to receiving the leading-edge detection signal DS1, the counter-ejector control device 257 supplies a motion activation instruction to the motion controller 259.

According to the motion activation instruction, the motion controller 259 executes the position-instruction creation program stored in the internal memory 259A. Through the execution of the position-instruction creation program, the motion controller 259 creates a position instruction every given control cycle, according to the already created speed pattern SPS, and sequentially supplies position instructions to the drive control circuit 260. According to the position instruction, the drive control circuit 260 controls a supply electricity to the drive motor MP2 every given control cycle.

Figure 7A:
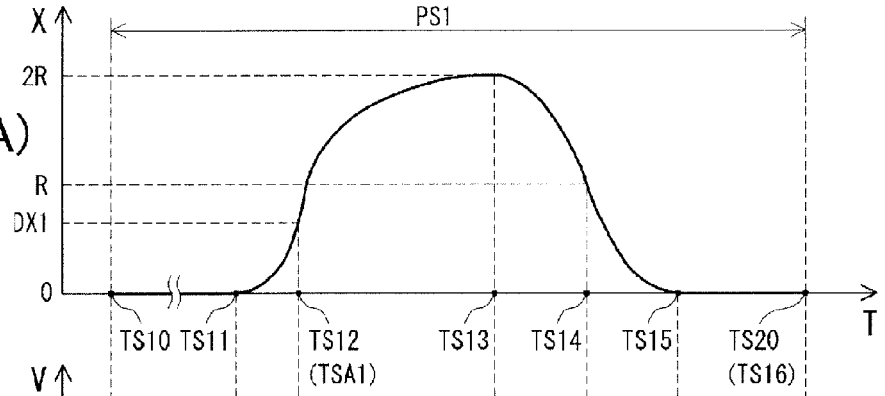
FIGS. 7(A) and 7(B) are time charts illustrating, respectively, a positional coordinate X and the speed pattern SPS of the sheet stopper in the counter-ejector according to the above embodiment, in the case where the length of the corrugated paperboard sheet SH is relatively short.
Figure 7B:
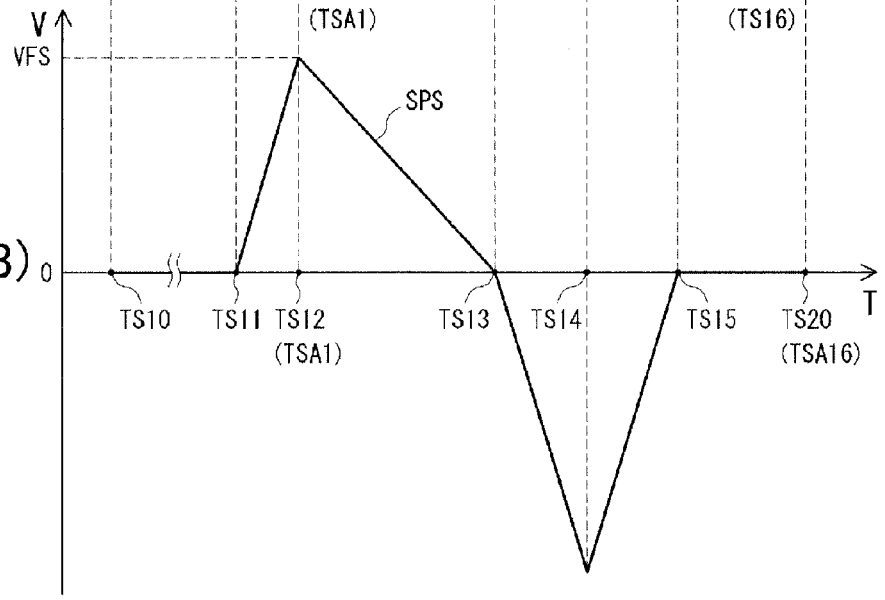

With reference to FIGS. 7(A) and 7(B), the position instructions to be created through the execution of the position-instruction creation program will be described. FIG. 7(A) indicates a positional coordinate X of the sheet stoppers on the vertical axis, and an elapsed time T on the horizontal axis. FIG. 7(B) illustrates the speed pattern SPS for the short-sheet order, as with FIG. 6(B). Referring to FIG. 4, the positional coordinate X of the sheet stopper 101B is set by defining as an origin thereof a position of the contact surface 130B of the sheet stopper 101B located at the first position. In FIG. 7(A), when the positional coordinate X of the sheet stopper 101B is "0", it means that the contact surface 130B of the sheet stopper 101B is located at the origin.

According to the motion activation instruction based on the leading-edge detection signal DS1, the motion controller 259 generates a position instruction for causing the positional coordinate X of the sheet stopper 101B to be set to "0", during the time period between the time TS10 and the time TS11. Thus, during the time period between the time TS10 and the time TS11, the sheet stopper 101B is kept static at the first position illustrated in FIG. 4.

Figure 8:
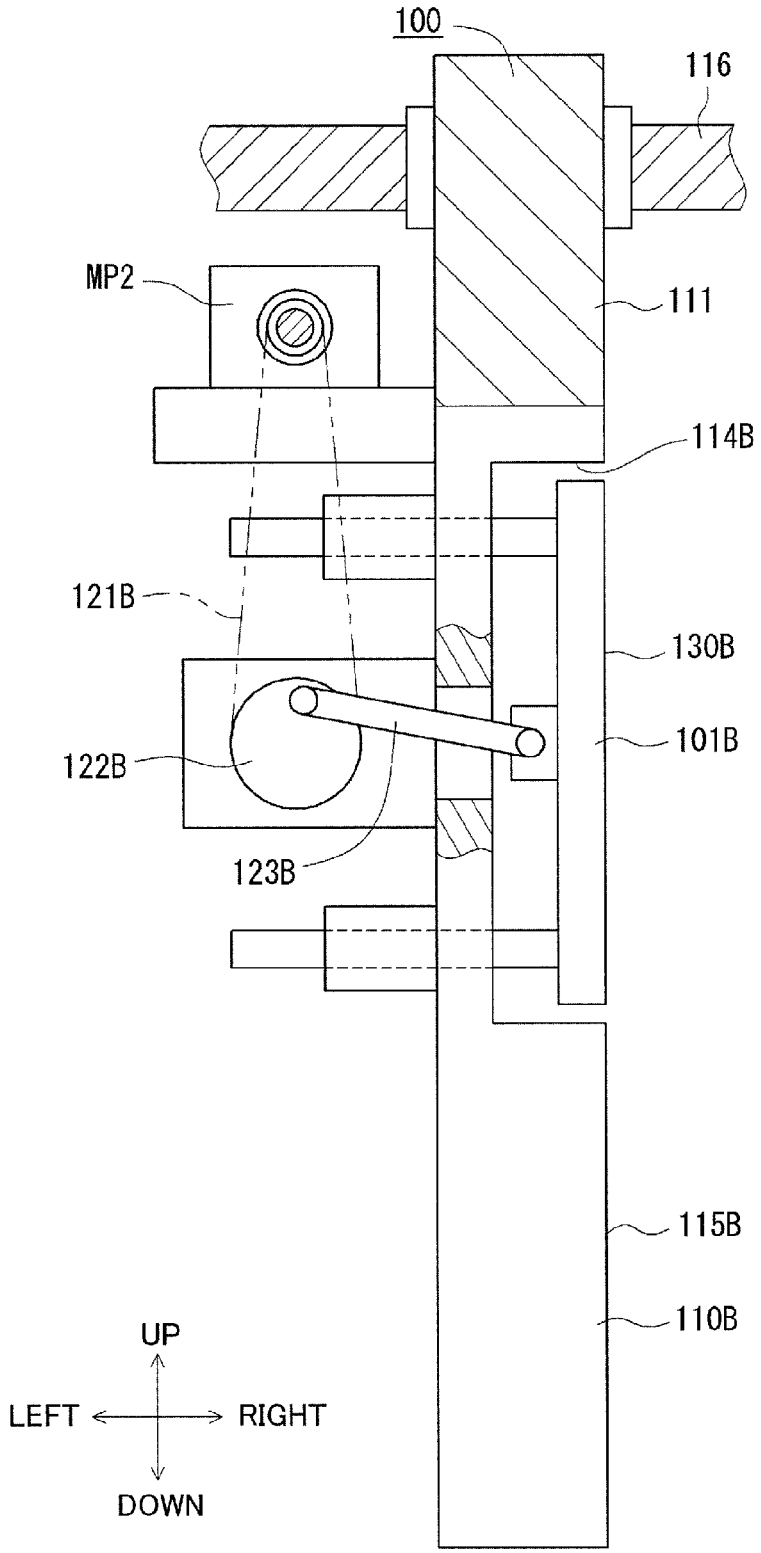
FIG. 8 is an explanatory diagram illustrating a state when a movement speed V of the sheet stopper being moved from the first position toward the second position reaches a maximum movement speed equal to a conveyance speed VFS.

During the time period between the time TS11 to the time TS12 (TSA1), the motion controller 259 generates a position instruction every given control cycle to allow the positional coordinate X to be changed from "0" to a value corresponding to the distance DX1 and allow a change amount per unit time of the positional coordinate X to rapidly increase. Thus, the movement speed V of the sheet stopper 101B is rapidly increased to reach the maximum movement speed equal to the conveyance speed VFS at the time TS12 (TSA1). FIG. 8 illustrates the position of the sheet stopper 101B at the time TS12 (TSA1). In FIG. 8, the contact surface 130B of the sheet stopper 101B is flush with the contact surface 115B of the support portion 110B. In this embodiment, the leading edge of the short-type corrugated paperboard sheet SH comes into contact with the contact surface 130B of the sheet stopper 101B at the time TS12 (TSA1). At the contact time TS (TSA1), the movement speed V of the sheet stopper 101B is equal to the conveyance speed VFS of the short-type corrugated paperboard sheet SH. Thus, a contact force acting on each of the sheet stopper 101B and the short-type corrugated paperboard sheet SH when they initially come into contact with each other becomes significantly small. A value of the positional coordinate X of the sheet stopper 101B at the contact time TS12 (TSA1) represents a position corresponding to the distance DX1 which is less than the radius R.

Figure 9:
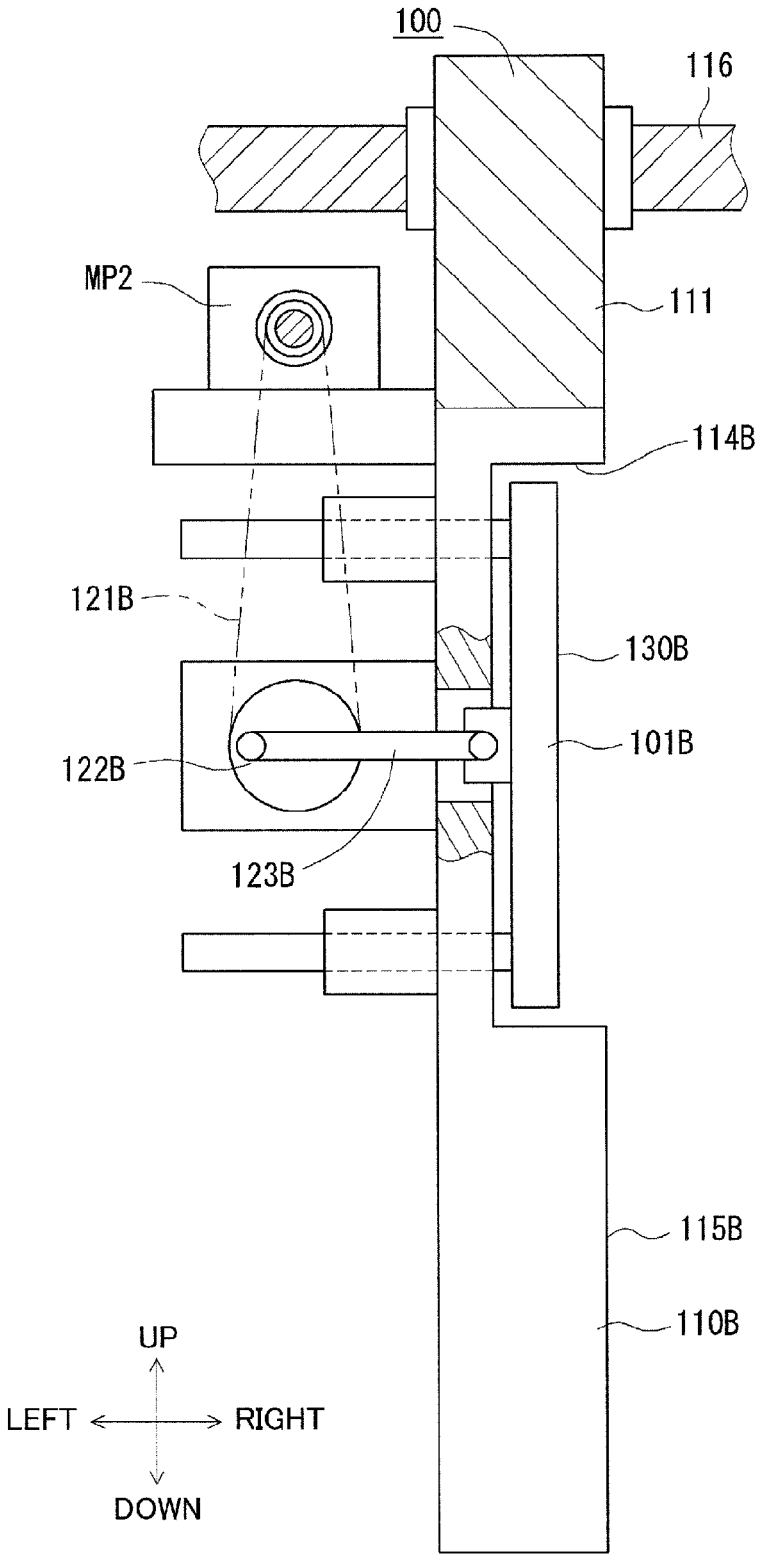
FIG. 9 is an explanatory diagram illustrating a state when the sheet stopper is retracted to the second position.

During the time period between the time the time TS12 (TSA1) to the time TS13, the motion controller 259 generates a position instruction every given control cycle to allow the positional coordinate X to be changed from a value corresponding to the distance DX1 to a value corresponding to two times of the radius R and allow the change amount per unit time of the positional coordinate X to gradually decrease. Thus, the movement speed V of the sheet stopper 101B is slowly reduced to reach "0" at the time TS13. FIG. 9 illustrates the position of the sheet stopper 101B at the time TS13. In FIG. 9, the contact surface 130B of the sheet stopper 101B is located at a position where it is moved leftwardly farthest away from the contact surface 115B of the support portion 110B, i.e., located at the second position. In this embodiment, the time period between the time TS11 and the time TS12 (TSA1) is maximally shortened in view of the output capacity of the drive motor MP2, so that the time period between the time TS12 (TSA1) and the time TS13 can be maximally extended. Therefore, in the time period between the time TS12 (TSA1) and the time TS13, a movement speed V of the short-type corrugated paperboard sheet SH whose leading edge is in contact with the sheet stopper 101B is slowly reduced along with the negative acceleration of the sheet stopper 101B. Thus, a contact force acting between the sheet stopper 101B and the short-type corrugated paperboard sheet SH during the contact therebetween becomes a small value depending on the negative acceleration.

Figure 10:
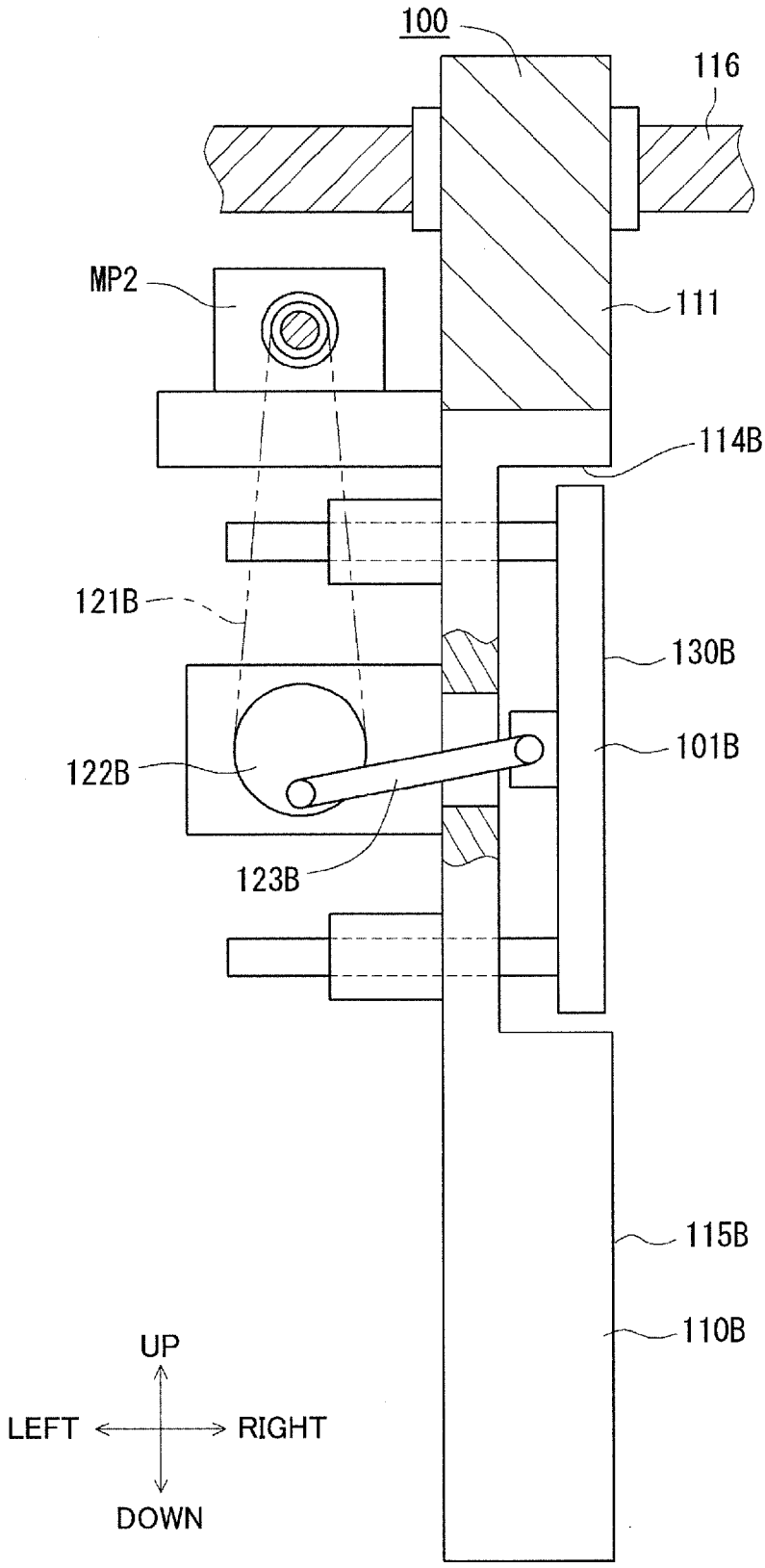
FIG. 10 is an explanatory diagram illustrating a state when the sheet stopper is being moved from the second position to the first position.

During the time period between the time TS13 and the time TS14, the motion controller 259 generates a position instruction every given control cycle to allow the positional coordinate X to be changed from the value corresponding to two times of the radius R to a value corresponding to the radius R and allow the change amount per unit time of the positional coordinate X to rapidly increase. Thus, the movement speed V of the sheet stopper 101B is rapidly increased. FIG. 10 illustrates the position of the sheet stopper 101B at the time TS14. In FIG. 10, the contact surface 130B of the sheet stopper 101B is located at a position leftwardly slightly away from the contact surface 115B of the support portion 110B.

During the time period between the time TS14 and the time TS15, the motion controller 259 generates a position instruction every given control cycle to allow the positional coordinate X to be changed from the value corresponding to the radius R to "0" and allow the change amount per unit time of the positional coordinate X to rapidly decrease. Thus, the movement speed V of the sheet stopper 101B is rapidly reduced. At the time TS15, the contact surface 130B of the sheet stopper 101B is returned to a position where it is moved rightwardly farthest away from the contact surface 115B of the support portion 110B, i.e., returned to the first position illustrated in FIG. 4.

During the time period between the time TS15 and the time TS20 (TS16), the motion controller 259 generates a position instruction for causing the positional coordinate X to be set to "0". Thus, during the time period between the time TS15 and the time TS20 (TS16), the sheet stopper 101B is kept static at the first position illustrated in FIG. 4. During the time period PS1 for transferring the first short-type corrugated paperboard sheet SH, the drive control circuit 260 operates to cause the sheet stoppers 101B to 101M to perform one cycle of the reciprocating motion between the first position and the second position, according to position instructions sequentially supplied from the motion controller 259 in accordance with the speed pattern SPS.

Subsequently, when a passing of a leading edge of a second one of the short-type corrugated paperboard sheets SH is detected by the leading-edge detector SN1, the leading-edge detection signal DS2 illustrated in FIG. 6(A) is generated. In response to receiving the leading-edge detection signal DS2, the counter-ejector control device 257 supplies a motion activation instruction to the motion controller 259. During the time period PS2 for transferring the second short-type corrugated paperboard sheet SH, the drive control circuit 260 operates to cause the sheet stoppers 101B to 101M to perform one cycle of the reciprocating motion between the first position and the second position, according to position instructions sequentially supplied from the motion controller 259 in accordance with the speed pattern SPS, in the same manner as that during the time period PS1. One cycle of the reciprocating motion the sheet stoppers 101B to 101M will be repeatedly executed every time period for transferring short-type corrugated paperboard sheet SH, until the short-sheet order is completed.

<Reciprocating Motion of Sheet Stoppers in Long-Sheet Order>

Before starting execution of the long-sheet order, the counter-ejector control device 257 receives, from the lower-level management device 210, control instruction information including: speed information indicative of the maximum conveyance speed; conveyance speed information as an instruction about the conveyance speed VFS of the long-type corrugated paperboard sheet SH; and sheet size information indicative of the length of the long-type corrugated paperboard sheet SH in the conveyance direction FD, and supplies the received control instruction information to the motion controller 259.

The motion controller 259 executes the speed-pattern creation program stored in the internal memory 259A to create a speed pattern SPL according to the speed information indicative of the maximum conveyance speed, the conveyance speed information, and the sheet size information, among the control instruction information, and stores therein the created speed pattern SPL.

In response to operator's manual operation of the sheet feed button 241 in order to execute the long-sheet order, the sheet feed device 2 starts to feed the corrugated paperboard sheets SH one-by-one. Then, when a passing of a leading edge of a first one of the long-type corrugated paperboard sheets SH to which given processings are made is detected by the leading-edge detector SN1, the leading-edge detection signal DL1 illustrated in FIG. 6(C) is generated. In response to receiving the leading-edge detection signal DL1, the counter-ejector control device 257 supplies a motion activation instruction to the motion controller 259.

According to the motion activation instruction, the motion controller 259 executes the position-instruction creation program stored in the internal memory 259A. Through the execution of the position-instruction creation program, the motion controller 259 creates a position instruction every given control cycle, according to the already created speed pattern SPL, and sequentially supplies position instructions to the drive control circuit 260. According to the position instruction, the drive control circuit 260 controls a supply electricity to the drive motor MP2 every given control cycle.

Figure 11A:
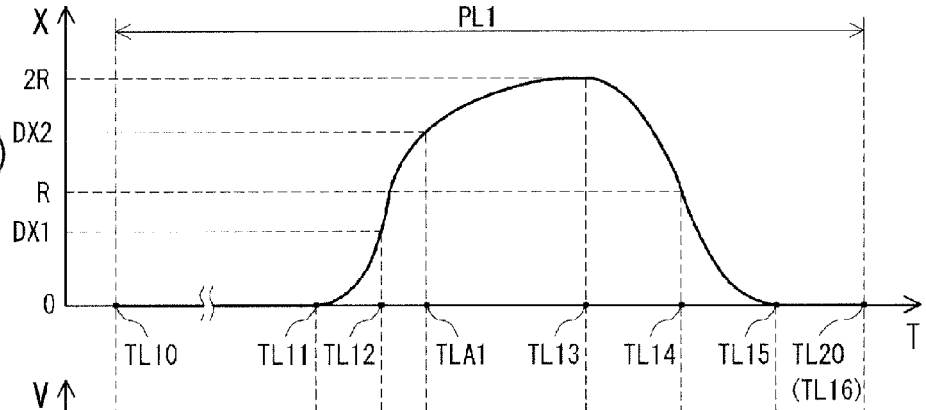
FIGS. 11(A) and 11(B) are time charts illustrating, respectively, a positional coordinate X and the speed pattern SPL of the sheet stopper in the counter-ejector according to the above embodiment, in the case where the length of the corrugated paperboard sheet SH is relatively long.
Figure 11B:
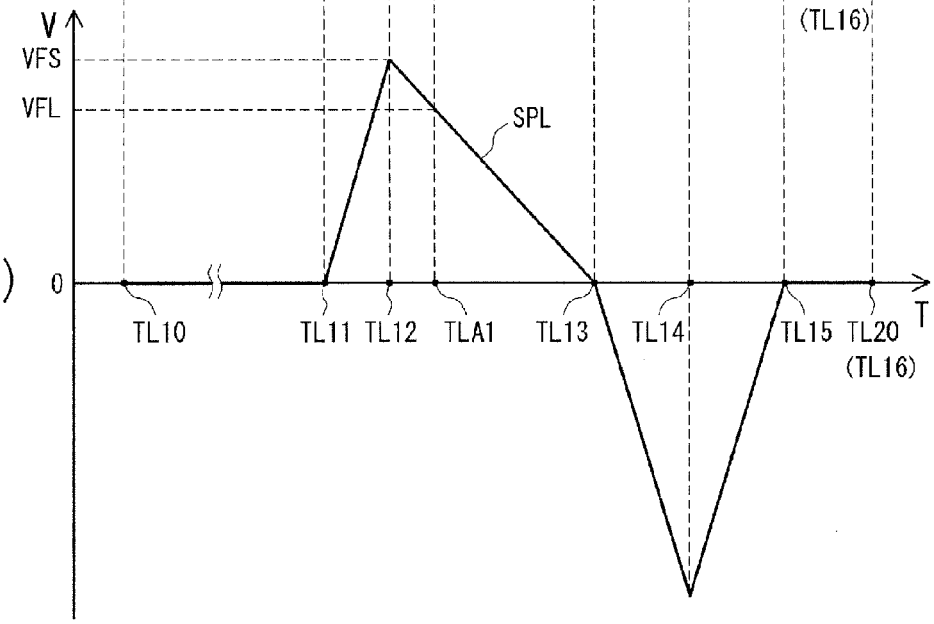

With reference to FIGS. 11(A) and 11(B), the position instructions to be created through the execution of the position-instruction creation program will be described. FIG. 11(A) indicates a positional coordinate X of the sheet stoppers on the vertical axis, and an elapsed time T on the horizontal axis. FIG. 11(B) illustrates the speed pattern SPS for the long-sheet order, as with FIG. 6(D). Referring to FIG. 4, the positional coordinate X of the sheet stopper 101B is set by defining as an origin thereof a position of the contact surface 130B of the sheet stopper 101B located at the first position. In FIG. 11(A), when the positional coordinate X of the sheet stopper 101B is "0", it means that the contact surface 130B of the sheet stopper 101B is located at the origin.

According to the motion activation instruction based on the leading-edge detection signal DL1, the motion controller 259 generates a position instruction for causing the positional coordinate X of the sheet stopper 101B to be set to "0", during the time period between the time TL10 and the time TL11. Thus, during the time period between the time TL10 and the time TL11, the sheet stopper 101B is kept static at the first position illustrated in FIG. 4.

During the time period between the time TL11 to the time TL12, the motion controller 259 generates a position instruction every given control cycle to allow the positional coordinate X to be changed from "0" to a value corresponding to the distance DX1 and allow a change amount per unit time of the positional coordinate X to rapidly increase. Thus, the movement speed V of the sheet stopper 101B is rapidly increased to reach the maximum movement speed equal to the conveyance speed VFS at the time TL12. As illustrated in FIG. 8, at the time TL12, the contact surface 130B of the sheet stopper 101B is flush with the contact surface 115B of the support portion 110B. In this embodiment, the leading edge of the long-type corrugated paperboard sheet SH does not come into contact with the contact surface 130B of the sheet stopper 101B at the time TL12.

During the time period between the time the time TL12 to the time TL13, the motion controller 259 generates a position instruction every given control cycle to allow the positional coordinate X to be changed from a value corresponding to the distance DX1 to a value corresponding to two times of the radius R and allow the change amount per unit time of the positional coordinate X to gradually decrease. Thus, the movement speed V of the sheet stopper 101B is slowly reduced to reach "0" at the time TL13. In this embodiment, the long-type corrugated paperboard sheet SH is conveyed at the conveyance speed VFL less than the conveyance speed VFS, i.e., the maximum conveyance speed. Thus, the leading edge of the long-type corrugated paperboard sheet SH comes into contact with the sheet stopper 101B when the movement speed V of the sheet stopper 101B is reduced from the maximum movement speed to reach a speed equal to the conveyance speed VFL. At the contact time TLA1, the movement speed V of the sheet stopper 101B is equal to the conveyance speed VFL of the long-type corrugated paperboard sheet SH. Thus, a contact force acting between the sheet stopper 101B and the long-type corrugated paperboard sheet SH when they initially come into contact with each other becomes significantly small. A value of the positional coordinate X of the sheet stopper 101B at the contact time TLA1 represents a position corresponding to the distance DX2 which is greater than the radius R. At the time TL13, the contact surface 130B of the sheet stopper 101B is located at a position where it is moved leftwardly farthest away from the contact surface 115B of the support portion 110B, i.e., located at the second position.

In this embodiment, the time period between the time TL11 and the time TL12 is maximally shortened in view of the output capacity of the drive motor MP2, so that the time period between the time TL12 and the time TL13 can be maximally extended. Therefore, in the time period between the time TL12 and the time TL13, a movement speed V of the long-type corrugated paperboard sheet SH whose leading edge is in contact with the sheet stopper 101B is slowly reduced along with the negative acceleration of the sheet stopper 101B. Thus, a contact force acting between the sheet stopper 101B and the long-type corrugated paperboard sheet SH during the contact therebetween becomes a small value depending on the negative acceleration.

During the time period between the time TL13 and the time TL14, the motion controller 259 generates a position instruction every given control cycle to allow the positional coordinate X to be changed from the value corresponding to two times of the radius R to a value corresponding to the radius R and allow the change amount per unit time of the positional coordinate X to rapidly increase. Thus, the movement speed V of the sheet stopper 101B is rapidly increased. As illustrated in FIG. 10, the contact surface 130B of the sheet stopper 101B is located at a position leftwardly slightly away from the contact surface 115B of the support portion 110B.

During the time period between the time TL14 and the time TL15, the motion controller 259 generates a position instruction every given control cycle to allow the positional coordinate X to be changed from the value corresponding to the radius R to "0" and allow the change amount per unit time of the positional coordinate X to rapidly decrease. Thus, the movement speed V of the sheet stopper 101B is rapidly reduced. At the time TL15, the contact surface 130B of the sheet stopper 101B is returned to a position where it is moved rightwardly farthest away from the contact surface 115B of the support portion 110B, i.e., returned to the first position illustrated in FIG. 4.

During the time period between the time TL15 and the time TL20 (TL16), the motion controller 259 generates a position instruction for causing the positional coordinate X to be set to "0". Thus, during the time period between the time TL15 and the time TL20 (TL16), the sheet stopper 101B is kept static at the first position illustrated in FIG. 4. During the time period PL1 for transferring the first long-type corrugated paperboard sheet SH, the drive control circuit 260 operates to cause the sheet stoppers 101B to 101M to perform one cycle of the reciprocating motion between the first position and the second position, according to position instructions sequentially supplied from the motion controller 259 in accordance with the speed pattern SPL.

Subsequently, when a passing of a leading edge of a second one of the long-type corrugated paperboard sheets SH is detected by the leading-edge detector SN1, the leading-edge detection signal DL2 illustrated in FIG. 6(C) is generated. In response to receiving the leading-edge detection signal DL2, the counter-ejector control device 257 supplies a motion activation instruction to the motion controller 259. During the time period PL2 for transferring the second long-type corrugated paperboard sheet SH, the drive control circuit 260 operates to cause the sheet stoppers 101B to 101M to perform one cycle of the reciprocating motion between the first position and the second position, according to position instructions sequentially supplied from the motion controller 259 in accordance with the speed pattern SPL, in the same manner as that during the time period PL1. One cycle of the reciprocating motion the sheet stoppers 101B to 101M will be repeatedly executed every time period for transferring long-type corrugated paperboard sheet SH, until the long-sheet order is completed.

<<Advantageous Effects of Embodiment>>

In the counter-ejector 8 (sheet stacking apparatus) according to the above embodiment, the leading edge of the corrugated paperboard sheet comes into contact with the sheet stoppers 101B to 101M, at the time TSA1 when the sheet stoppers 101B to 101M are being moved from the first position toward the second position, and the movement speed V of the stoppers reaches the maximum movement speed, or at the time TLA1 when the movement speed V of the stoppers is being reduced from the maximum movement speed. In addition, at the contact time TSA1 (TLA1), the movement speed V of the stoppers is equal to the conveyance speed VFS (VFL) of the corrugated paperboard sheet SH. Therefore, when the corrugated paperboard sheet SH initially comes into contact with the sheet stoppers 101B to 101M, they are moved in the same direction at the same speed, so that a contact force acting therebetween becomes significantly small. This makes it possible to suppress damage to the corrugated paperboard sheet DH when the corrugated paperboard sheet initially comes into contact with the sheet stoppers 101B to 101M.

In this embodiment, the movement speed V of the stoppers is slowly reduced from the maximum movement speed, during the time period between the time TS12 and the time TS13, or during the time period between the time TL12 and the time TL13. Therefore, the movement speed of the corrugated paperboard sheet SH whose leading edge is in contact with the sheet stoppers 101B to 101M is also slowly reduced, so that a contact force acting therebetween becomes a small value depending on the negative acceleration. This makes it possible to reliably suppress damage to the corrugated paperboard sheet SH, when the corrugated paperboard sheet SH is in contact with the sheet stoppers 101B to 101M until it reaches a static state.

In the counter-ejector 8, the main ledge 83 is typically configured such that the branched horizontally-extending portions 83A thereof are penetratingly inserted, respectively, into interspaces between the support portions 110A to 110N. In a conventional apparatus devoid of the sheet stoppers 101B to 101M, a leading edge of the corrugated paperboard sheet SH comes into contact with the support portions 110A to 110N, and thereby a plurality of damaged portions each corresponding to a shape or size of a respective one of the support portions are formed in the leading edge at intervals of the support portions. Differently from this, in the above embodiment, the sheet stoppers 101B to 101M are installed, respectively, in the support portions 110A to 110N, so that it becomes possible to suppress damage due to the support portions.

In the above embodiment, the contact surface (e.g., contact surface 130B) of each of the sheet stoppers 101B to 101M is reciprocatingly moved between the first position on the upstream side and the second position on the downstream side in the conveyance direction FD, with respect to the contact surface (e.g., contact surface 115B) of a corresponding one of the support portions 110B to 110M. Thus, as compared to a configuration in which the second position is set to a position of the contact surfaces of support portions 110A to 110N, the counter-ejector 8 according to the above embodiment makes it possible to suppress the occurrence of a situation where a rear edge of the corrugated paperboard sheet SH is caught by the correction plate 82 and is thereby likely to fail to be normally stacked. Further, as compared to a configuration in which the first position is set to the position of the contact surfaces of the support portions 110A to 110N, the counter-ejector 8 according to the above embodiment makes it possible to allow the leading edge of the corrugated paperboard sheet SH to initially come into contact with the sheet stoppers 101B to 101M at an earlier timing to thereby ensure a relatively long standby time period between the time TS15 and the time TS20 (TS16). Thus, it is not necessary to shorten the time period between the time TS13 and the time TS15. This eliminates a need to drive the drive motor MP2 at excessively high speeds.

In this embodiment, the contact surfaces of the sheet stoppers 101B to 101M are disposed in a relatively upper region of the leading-edge regulating member 100, and the contact surfaces of the support portions 110A to 110N are arranged in a relatively lower region of the leading-edge regulating member 100. Therefore, as compared to a configuration where the sheet stoppers are installed over the entire length of the leading-edge regulating member 100 in the up-down direction, it becomes possible to reduce the weight of the sheet stoppers to thereby allow the sheet stoppers to be moved at a higher speed. Further, in the above embodiment, the leading edges of the corrugated paperboard sheets SH stopped by the sheet stoppers 101B to 101M being reciprocatingly moved can be accurately aligned by the contact surfaces of the support portions 110A to 110N lying at a fixed position.

[Modifications]

An advantageous embodiment of the invention has been shown and described. It is obvious to those skilled in the art that various changes and modifications may be made therein without departing from the spirit and scope thereof as set forth in appended claims.

Figures 12A, 12B:
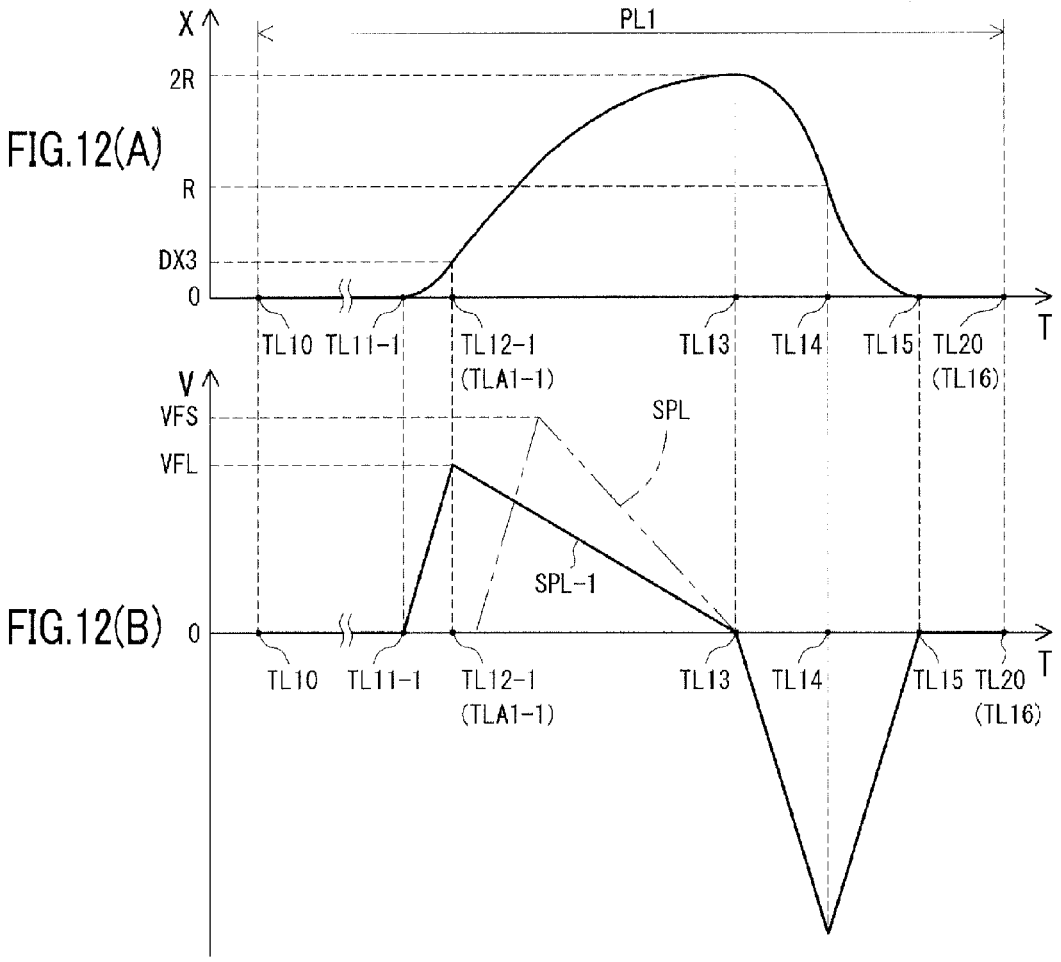
FIGS. 12(A) and 12(B) are time charts illustrating, respectively, a positional coordinate X and a speed pattern SPL-1 of a sheet stopper in a counter-ejector according to a modified embodiment of the present invention, in the case where the length of the corrugated paperboard sheet SH is relatively long.

(1) In the above embodiment, in the speed pattern SPS for the short-type corrugated paperboard sheet SH and the speed pattern SPL for the long-type corrugated paperboard sheet SH, a shape in the time period between the time TS11 and the time TS15 is identical to a shape in the time period between the time TL11 and the time TL15. However, the present invention is not limited thereto. That is, the shape of the speed pattern may be changed depending on the length of the corrugated paperboard sheet SH in the conveyance direction FD, and the conveyance speed. For example, in the case where the corrugated paperboard sheet SH is the long type and is conveyed at the conveyance speed VFL, a speed pattern SPL-1 having a shape indicated by the solid line in FIG. 12 may be created. A shape of the speed pattern SPL-1 in a time period between time TL11-1 and time TL13 is different from a shape of the speed pattern SPL in FIG. 11 in the time period between the time TL11 and the time TL13. A part of the speed pattern SPL different from the speed pattern SPL-1 is indicated in FIG. 12 by the two-dot chain line. In the speed pattern SPL-1, the movement speed V of the sheet stopper 101B reaches the conveyance speed VFL, i.e., the maximum movement speed, at time TL12-1 (TLA1-1). An acceleration of the movement speed V of the sheet stoppers, in the time period between the time TL11-1 and the time TL12-1 in the speed pattern SPL-1 is equal to an acceleration of the movement speed V of the sheet stoppers, in the time period between the time TL11 and the time TL12 in the speed patter SPL. The time period between the time TL11-1 and the time TL12-1 in the speed pattern SPL-1 is set to allow an area of a triangular-shaped region of the speed pattern SPL-1 in the time period between the time TL11-1 and the time TL13 to become equal to an area of a triangular-shaped region of the speed pattern SPL-1 in the time period between the time TL13 and the time TL15. At the time TL12-1 (TLA1-1), the leading edge of the long-type corrugated paperboard sheet SH initially comes into contact with the contact surface 130B of the sheet stopper 101B. Then, the movement speed V of the sheet stopper 101B is slowly reduced over a longer time period, as compared to the speed pattern SPL. At the initial-contact time TL12-1 (TLA1-1), the contact surface 130B of the sheet stopper 101B is located at a position where it is moved from the origin by the distance DX3. A time period between time TL10 and the time TL12-1 (TLA1-1) is determined by: subtracting the distance DX3 from the distance DX1; subtracting the resulting value (DX1−DX3) from a sum (L1+L2) of the distance L1 and the distance L2; and dividing the resulting value [(L1+L2)−(DX1−DX3)] by the conveyance speed VFL. In this case, the distance L2 is the length of the long-type corrugated paperboard sheet SH in the conveyance direction FD.

(2) In this embodiment, the motion controller 259 is configured to start creation of a position instruction at a time when the leading-edge detector SN1 detects the passing of the leading edge of the corrugated paperboard sheet SH. However, the present invention is not limited thereto. For example, the motion controller 259 may be configured to start creation of a position instruction at a time when a detector detects a passing of a trailing edge of the corrugated paperboard sheet SH. Alternatively, the motion controller 259 may be configured to create and store position instructions in accordance with a speed pattern before a start of execution of an order, and, after the start of the execution of the order, start reading of the position instructions according to each detection signal from the detector to supply each position instruction every given control cycle to the drive control circuit 260.

(3) In the above embodiment, the sheet stoppers 101B to 101M are made of a lightweight material having wear resistance, such as aluminum. However, the present invention is not limited thereto. For example, each of the contact surfaces of the sheet stoppers 101B to 101M may be provided with a plate spring and a protective plate, as disclosed in the Patent Document 1. In this modification, a contact force acting on the contact surface of the sheet stopper also becomes smaller than the conventional apparatus. Thus, it becomes possible to reduce burden of maintenance/inspection work and replacement work for the plate spring and the protective plate.

(4) It is preferable that the leading-edge detector SN1 is installed at a position possibly close to the counter-ejector 8. From this point of view, in the above embodiment, the leading-edge detector SN1 is installed above the sheet transfer device 7 disposed between the counter-ejector 8 and the folder-gluer 6. However, the present invention is not limited thereto. For example, the leading-edge detector SN1 may be installed on an upstream side of the folder-gluer 6.

(5) Although the counter-ejector 8 according to the above embodiment is configured such that, at the time TS10 (TL10) when the leading-edge detector SN1 detects the passing of the leading edge of the corrugated paperboard sheet SH, the sheet stoppers 101B to 101M are kept in a standby state at the first position illustrated FIG. 4, the present invention is not limited thereto. For example, the counter-ejector may be configured such that, at the time TS10 (TL10), the sheet stoppers 101B to 101M are kept in a standby state at the second position illustrated FIG. 9, and, after the leading-edge detector SN1 detects the passing of the leading edge of the corrugated paperboard sheet SH, the sheet stoppers 101B to 101M are moved from the second position to the first position.

(6) In the above embodiment, as regards the speed patters SPS, SPL, the movement speed V of the sheet stoppers is linearly increased and reduced, i.e., each of the positive acceleration and the negative acceleration is set to a constant value. However, the present invention is not limited thereto. For example, the negative acceleration of the movement speed V of the sheet stoppers, in the time period between the time TL12 and the time TL13, may be changed in a stepwise manner, or continuously changed in a curved manner.

(7) In this embodiment, a time period during which the movement speed V of the sheet stopper is reduced from the maximum movement speed to the static state, i.e., the time period between the time TS12 and the time TS13, or the time period between the time TL12 and the time TL13, is set to a constant value in each of the speed patterns SPS, SPL. Alternatively, this deceleration time period may be set such that it becomes longer as the conveyance speed of the corrugated paperboard sheet SH becomes higher. In this modification, the counter-ejector 8 may be configured such that the negative acceleration of the movement speed V of the sheet stoppers, is changed over the elapsed time, instead of being kept constant. Further, in the case where the conveyance speed of the corrugated paperboard sheet SH is relatively low, the time period between the time TL11 and the time TL12 and the time period between the time TL12 and the time TL13 may be set to the same value.

(8) Although the counter-ejector 8 according to the above embodiment is configured such that rotation of the single drive motor MP2 is transmitted to the plurality of rotors 122B to 122M via the plurality of drive pulleys 120B to 120M and the plurality of transmission belts 121B to 121M, the present invention is not limited thereto. For example, the counter-ejector may comprise control means configured to control a plurality of drive motors to rotate a plurality of rotors, respectively, while synchronizing rotations of the plurality of drive motors.

(9) Although the counter-ejector 8 according to the above embodiment is configured such that the leading edge of the corrugated paperboard sheet SH initially comes into contact with the sheet stoppers, at the time TS12 (TSA1) or the time TLA1 when the movement speed V of the sheet stopper reaches the conveyance speed VFS or VFL, the present invention is not limited thereto. For example, the counter-ejector may be configured to create the speed pattern SPS to set the time TS11 at a later timing, or create the speed pattern SPL in such a manner as to set the time TL11 at an earlier timing, so as to allow the leading edge of the corrugated paperboard sheet SH to initially come into contact with the sheet stoppers, before the time TS12 when the movement speed V reaches the conveyance speed VFS, or after the time TLA1 when the movement speed V reaches the conveyance speed VFL.

(10) The above embodiment has been described on the assumption that the movement speed of the corrugated paperboard sheet SH is approximately equal to the conveyance speed VFS (VFL), during the time period from a time when the corrugated paperboard sheet SH is stacked from the sheet transfer device 7 through until the leading edge of the corrugated paperboard sheet SH initially comes into contact with the sheet stoppers. However, considering that the movement speed of the corrugated paperboard sheet SH is gradually lowered, the motion controller 259 may be configured to perform correction to reduce the maximum movement speed of the speed pattern SPS (SPL), or to set the TS11 (TL11) at an earlier timing.

(11) In this embodiment, as illustrated in FIG. 9, a portion where a lower edge of the recess 114B connects to the contact surface 115B the leading-edge regulating member 100B is formed as an angled corner. Alternatively, this connecting portion may be chamfered to form a surface inclined obliquely downwardly and rightwardly. In this embodiment, it is deemed that the leading edge of the corrugated paperboard sheet SH moves toward the second position while being in contact with the contact surface 130B of the sheet stopper 101B, and becomes static at the second position, or moves toward the second position while being in contact with the contact surface 130B of the sheet stopper 101B, and becomes static just before the second position. The corrugated paperboard sheet SH in a static state will fall down under its own weight. In the above modification characterized by chamfering, when the second position of the sheet stopper 101B in FIG. 9 is set on a downstream side with respect to the contact surface 115B of the leading-edge regulating member 100B in the conveyance direction FD, the leading edge of the corrugated paperboard sheet SH being falling can smoothly move downwardly along the above inclined surface without being caught by the lower edge of the recess 114B.

What is claimed is:

1. A sheet stacking apparatus comprising:

a hopper section configured to allow a plurality of folded and glued corrugated paperboard sheets to be stacked therein from a sheet transfer section in a transfer direction and stacked therein;

a leading-edge regulating member configured to be positionally adjustable depending on a length of the corrugated paperboard sheets in the transfer direction so as to delimit a downstream-side position of a stacking space of the hopper section in the transfer direction, the leading-edge regulating member having a contact surface contactable with respective leading edges of the stacked corrugated paperboard sheets;

a sheet stopper installed in the leading-edge regulating member in such a manner as to be movable in the transfer direction with respect to the contact surface of the leading-edge regulating member reciprocatingly between a first position and a second position set downstream of the first position, and contactable with the leading edge of the corrugated paperboard sheet to be stacked in the hopper section;

a detection section disposed upstream of the hopper section in the transfer direction, and configured to detect a passing of each of the corrugated paperboard sheets; and a synchronization control device configured to reciprocatingly move the sheet stopper according to a detection signal from the detection section, in such a manner as to allow the leading edge of the corrugated paperboard sheet to come into contact with the sheet stopper being moved from the first position toward the second position.

2. The sheet stacking apparatus according to claim 1, wherein the synchronization control device comprises: a drive motor; a transmission mechanism for transmitting a driving force of the drive motor to the sheet stopper; and a drive control section for controlling driving of the drive motor according to the detection signal from the detection section.

3. The sheet stacking apparatus according to claim 2, wherein the drive control section is operable to control the driving of the drive motor according to the detection signal from the detection section, in such a manner as to allow the leading edge of the corrugated paperboard sheet to come into contact with the sheet stopper when a movement speed of the sheet stopper being moved from the first position toward the second position reaches a given maximum movement speed, or when the movement speed is being reduced from the given maximum movement speed.

4. The sheet stacking apparatus according to claim 3, wherein the drive control section is operable to control a driving speed of the drive motor, in such a manner as to move the sheet stopper from the first position toward the second position at a speed equal to or less than a transfer speed of the corrugated paperboard sheets.

5. The sheet stacking apparatus according to claim 2, wherein the transmission mechanism comprises a conversion mechanism for converting a rotational motion of a rotor configured to be driven by the drive motor, to a linear reciprocating motion of the sheet stopper, the conversion mechanism being installed in the leading-edge regulating member.

6. The sheet stacking apparatus according to claim 5, wherein the drive control section is operable to control the driving of the drive motor according to the detection signal from the detection section, in such a manner as to allow the sheet stopper to perform one cycle of the reciprocating motion, every time the sheet transfer section conveys and stacks one of the corrugated paperboard sheets into the hopper section.

7. The sheet stacking apparatus according to claim 2, wherein:

the leading-edge regulating member comprises a plurality of support portions arranged at given intervals in a width direction of the corrugated paperboard sheets being conveyed, and a frame to which the plurality of support portions are fixed; and the sheet stopper is provided in a plural number, and wherein:

the plurality of sheet stoppers are supported, respectively, by the plurality of support portions;

the drive motor is fixed to the frame; and the transmission mechanism is configured to transmit the driving force of the drive motor to each of the plurality of sheet stoppers.

8. The sheet stacking apparatus according to claim 2, wherein the drive control section is operable to sequentially execute:

a first operation of starting the driving of the drive motor according to the detection signal from the detection section, in such a manner as to allow the sheet stopper to start the movement from the first position toward the second position;

a second operation of controlling the driving of the drive motor in such a manner as to increase a movement speed of the sheet stopper being moved from the first position toward the second position to reach a given maximum movement speed; and a third operation of controlling the driving of the drive motor in such a manner as to reduce the movement speed of the sheet stopper from the given maximum movement speed to thereby allow the sheet stopper to reach the second position, and wherein a time period from the start of the driving of the drive motor in the first operation through until the movement speed of the sheet stopper reaches the given maximum movement speed in the second operation is shorter than a time period from a time when the movement speed of the sheet stopper reaches the given maximum movement speed in the second operation through until the sheet stopper reaches the second position.

9. The sheet stacking apparatus according to claim 8, wherein the drive control section is operable to calculate a time period from a time when the detection section generates the detection signal through until the driving of the drive motor is started in the first operation, based on a transfer speed of the corrugated paperboard sheets, and a distance between an installation position of the detection section and a predetermined position where the leading edge of the corrugated paperboard sheet comes into contact with the sheet stopper, in the transfer direction.

10. The sheet stacking apparatus according to claim 2, wherein the drive control section is operable to sequentially execute:

a first operation of starting the driving of the drive motor according to the detection signal from the detection section, in such a manner as to allow the sheet stopper to start the movement from the first position toward the second position;

a second operation of controlling the driving of the drive motor in such a manner as to increase a movement speed of the sheet stopper being moved from the first position toward the second position to reach a given maximum movement speed;

a third operation of controlling the driving of the drive motor in such a manner as to reduce the movement speed of the sheet stopper from the given maximum movement speed to thereby allow the sheet stopper to reach the second position;

a fourth operation of controlling the driving of the drive motor in such a manner as to allow the sheet stopper to start a movement from the second position toward the first position; and a fifth operation of stopping the driving of the drive motor when the sheet stopper reaches the first position, and maintaining a stopped state of the drive motor until the detection signal is subsequently newly generated.

11. The sheet stacking apparatus according to claim 9, wherein the drive control section is operable to calculate a time period from a time when the detection section generates the detection signal through until the driving of the drive motor is started in the first operation, based on a transfer speed of the corrugated paperboard sheets, and a distance between an installation position of the detection section and a predetermined position where the leading edge of the corrugated paperboard sheet comes into contact with the sheet stopper, in the transfer direction.

12. A sheet stacking method for a sheet stacking apparatus, the sheet stacking apparatus comprising: a hopper section configured to allow a plurality of folded and glued corrugated paperboard sheets to be stacked therein from a sheet transfer section in a transfer direction; and a leading-edge regulating member configured to be positionally adjustable depending on a length of the corrugated paperboard sheets in the transfer direction so as to delimit a downstream-side position of a stacking space of the hopper section in the transfer direction, wherein the leading-edge regulating member has a contact surface contactable with leading edges of the corrugated paperboard sheets, the sheet stacking method comprising:

a first movement step of, in one transfer period during which one of the corrugated paperboard sheets is stacked into the hopper section by the sheet transfer section, moving a sheet stopper reciprocatingly movable in the transfer direction with respect to the contact surface of the leading-edge regulating member, from a first position toward a second position set downstream of the first position;

a second movement step of, in the same transfer period as that during which the first movement step is executed, moving the sheet stopper from the second position to the first position;

a detection step of detecting a passing of each of the corrugated paperboard sheets at a position upstream of the hopper section in the transfer direction;

a synchronization step of causing the first movement step to be executed according to the detection of the passing of each of the corrugated paperboard sheets, in such a manner as to allow the leading edge of the corrugated paperboard sheet to come into contact with the sheet stopper being moved in the first movement step; and a stacking step of stacking in the hopper section the corrugated paperboard sheets stopped by coming into contact with the sheet stopper.

* * * * *